US010414018B2

(12) United States Patent
Maruyama et al.

(10) Patent No.: US 10,414,018 B2
(45) Date of Patent: Sep. 17, 2019

(54) APPARATUS AND METHOD FOR REGULATING SURFACE TEMPERATURE OF POLISHING PAD

(71) Applicant: Ebara Corporation, Tokyo (JP)

(72) Inventors: Toru Maruyama, Tokyo (JP); Hisanori Matsuo, Tokyo (JP); Yasuyuki Motoshima, Tokyo (JP); Yohei Eto, Tokyo (JP); Mitsunori Komatsu, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 15/436,559

(22) Filed: Feb. 17, 2017

(65) Prior Publication Data

US 2017/0239778 A1 Aug. 24, 2017

(30) Foreign Application Priority Data

Feb. 22, 2016 (JP) ..... 2016-031083
Jan. 31, 2017 (JP) ..... 2017-015389

(51) Int. Cl.
*B24B 37/015* (2012.01)
*B24B 37/20* (2012.01)

(52) U.S. Cl.
CPC ..... *B24B 37/015* (2013.01); *B24B 37/20* (2013.01)

(58) Field of Classification Search
CPC ..... B24B 37/015; B24B 37/20
USPC ..... 451/7
See application file for complete search history.

(56) References Cited

U.S. PATENT DOCUMENTS 2,384,225 A * 9/1945 Wilson ..... B24B 55/02 29/DIG. 63
5,036,630 A * 8/1991 Kaanta ..... B24B 37/015 451/288
5,605,488 A * 2/1997 Ohashi ..... B24B 37/30 451/259
5,690,540 A * 11/1997 Elliott ..... B24B 37/26 451/288
5,873,769 A * 2/1999 Chiou ..... B24B 37/015 257/E21.23
6,705,923 B2 * 3/2004 Liu ..... B24B 37/042 451/287

(Continued)

FOREIGN PATENT DOCUMENTS

JP 2015-044245 A 3/2015

*Primary Examiner* — George B Nguyen
(74) *Attorney, Agent, or Firm* — Leydig, Voit & Mayer, Ltd.

(57) ABSTRACT

There is disclosed an apparatus which can maintain a surface temperature of a polishing pad at a desired target temperature. The apparatus for regulating a surface temperature of a polishing pad, includes: a pad contact member which is contactable with a surface of the polishing pad and which has a heating flow passage and a cooling flow passage formed therein; a heating-liquid supply pipe coupled to the heating flow passage; a cooling-liquid supply pipe coupled to the cooling flow passage; a first flow control valve attached to the heating-liquid supply pipe; a second flow control valve attached to the cooling-liquid supply pipe; a pad-temperature measuring device configured to measure a surface temperature of the polishing pad; and a valve controller configured to operate the first flow control valve and the second flow control valve based on the surface temperature of the polishing pad.

15 Claims, 27 Drawing Sheets

(56) References Cited

U.S. PATENT DOCUMENTS

| | | | | |
|---|---|---|---|---|
| 2001/0041446 | A1 | 11/2001 | Takahashi | |
| 2003/0119429 | A1* | 6/2003 | Bright | B24B 37/015 451/67 |
| 2005/0284606 | A1* | 12/2005 | Stahl | F28D 7/06 165/58 |
| 2010/0279435 | A1* | 11/2010 | Xu | B24B 37/015 438/5 |
| 2011/0159782 | A1* | 6/2011 | Sone | B24B 37/015 451/7 |
| 2012/0220196 | A1* | 8/2012 | Maruyama | B24B 37/015 451/7 |
| 2015/0079881 | A1* | 3/2015 | Maruyama | B24B 37/015 451/53 |

* cited by examiner

APPARATUS AND METHOD FOR REGULATING SURFACE TEMPERATURE OF POLISHING PAD

CROSS REFERENCE TO RELATED APPLICATIONS

This document claims priorities to Japanese Patent Application No. 2016-031083 filed Feb. 22, 2016 and Japanese Patent Application No. 2017-015389 filed on Jan. 31, 2017, the entire contents of which are hereby incorporated by reference.

BACKGROUND

A CMP (chemical mechanical polishing) apparatus is used in a process of polishing a surface of a wafer in the manufacturing of a semiconductor device. The CMP apparatus is configured to hold and rotate the wafer with a top ring, and press the wafer against a polishing pad on a rotating polishing table to polish the surface of the wafer. During polishing, a polishing liquid (or slurry) is supplied onto the polishing pad, so that the surface of the wafer is planarized by the chemical action of the polishing liquid and the mechanical action of abrasive particles contained in the polishing liquid.

A polishing rate of the wafer depends not only on a polishing load on the wafer pressed against the polishing pad, but also on a surface temperature of the polishing pad. This is because the chemical action of the polishing liquid on the wafer depends on the temperature. Therefore, in the manufacturing of a semiconductor device, it is important to maintain an optimum surface temperature of the polishing pad during polishing of the wafer in order to increase the polishing rate of the wafer, and to keep the increased polishing rate constant.

From this viewpoint, a pad-temperature regulating apparatus is conventionally used to regulate a surface temperature of a polishing pad. FIG. 25 is a schematic view of a conventional pad-temperature regulating apparatus. As shown in FIG. 25, the pad-temperature regulating apparatus includes a pad contact member 111 which is to make contact with a surface of a polishing pad 103, and a fluid supply pipe 112 coupled to the pad contact member 111. The fluid supply pipe 112 branches into a hot water supply pipe 115 coupled to a hot water supply source, and a cold water supply pipe 116 coupled to a cold water supply source. A hot water valve 120 and a cold water valve 121 are attached to the hot water supply pipe 115 and the cold water supply pipe 116, respectively. Either hot water or cold water is selectively supplied to the pad contact member 111 by closing either the hot water valve 120 or the cold water valve 121.

FIG. 26 is a diagram showing operations of the hot water valve 120 and the cold water valve 121, and showing a change in the surface temperature of the polishing pad 103. The hot water valve 120 and the cold water valve 121 are operated based on the surface temperature of the polishing pad 103. In particular, when the surface temperature of the polishing pad 103 exceeds a preset upper limit, the hot water valve 120 is closed and the cold water valve 121 is opened. Similarly, when the surface temperature of the polishing pad 103 falls below a preset lower limit, the cold water valve 121 is closed and the hot water valve 120 is opened.

However, it takes a certain amount of time to cool down the pad contact member 111, because the hot water remains in the pad contact member 111 and in the fluid supply pipe 112 even after a liquid, to be supplied to the pad contact member 111, is switched from the hot water to the cold water. Similarly, it takes a certain amount of time to warm the pad contact member 111 even after the liquid, to be supplied to the pad contact member 111, is switched from the cold water to the hot water. Therefore, a large overshoot and a large undershoot occur at the change in the surface temperature of the polishing pad 103. As a result, the surface temperature of the polishing pad 103 fluctuates greatly.

FIG. 27 is a graph showing change in the surface temperature of the polishing pad 103 as observed when a target temperature of the polishing pad 103 is set at 60° C. As shown in FIG. 27, the surface temperature of the polishing pad 103 changes greatly with a variation of about 20° C. FIG. 28 is a graph showing change in the surface temperature of the polishing pad 103 as observed after making an adjustment to PID control parameters. Also in this case, the surface temperature of the polishing pad 103 changes with a certain degree of variation. FIG. 29 is a graph showing change in the surface temperature of the polishing pad 103 as observed when the target temperature is changed from 60° C. to 50° C. after making an adjustment to PID control parameters. As shown in FIG. 29, the surface temperature of the polishing pad 103 changes greatly again.

The conventional pad-temperature regulating apparatus thus has the problem that the surface temperature of the polishing pad 103 fluctuates greatly during polishing of a wafer and that a desired polishing rate (also referred to as removal rate) cannot be obtained.

SUMMARY OF THE INVENTION

According to embodiments, there are provided an apparatus and a method which can maintain a surface temperature of a polishing pad at a desired target temperature.

Embodiments, which will be described below, relate to an apparatus and a method for regulating a surface temperature of a polishing pad for use in polishing of a substrate, such as a wafer.

In an embodiment, there is provided an apparatus for regulating a surface temperature of a polishing pad, comprising: a pad contact member which is contactable with a surface of the polishing pad and which has a heating flow passage and a cooling flow passage formed therein; a heating-liquid supply pipe coupled to the heating flow passage; a cooling-liquid supply pipe coupled to the cooling flow passage; a first flow control valve attached to the heating-liquid supply pipe; a second flow control valve attached to the cooling-liquid supply pipe; a pad-temperature measuring device configured to measure a surface temperature of the polishing pad; and a valve controller configured to operate the first flow control valve and the second flow control valve based on the surface temperature of the polishing pad.

In an embodiment, the heating flow passage and the cooling flow passage extend adjacent to each other and extend in a spiral shape.

In an embodiment, the heating flow passage and the cooling flow passage are arranged along a circumferential direction of the polishing pad.

In an embodiment, the heating flow passage and the cooling flow passage are symmetrical with respect to a radial direction of the polishing pad.

In an embodiment, the valve controller is configured to determine a manipulated variable for the first flow control valve and a manipulated variable for the second flow control valve which are necessary to eliminate a difference between a target temperature and the surface temperature of the polishing pad.

In an embodiment, where a manipulated variable for the first flow control valve and a manipulated variable for the second flow control valve are each expressed as a numerical value ranging from 0% to 100%, the valve controller is configured to determine the manipulated variable for one of the first flow control valve and the second flow control valve by subtracting the manipulated variable for the other one of the first flow control valve and the second flow control valve from 100%.

In an embodiment, there is provided a method of regulating a surface temperature of a polishing pad, comprising: passing a heating liquid and a cooling liquid simultaneously through a heating flow passage and a cooling flow passage, respectively, while placing a pad contact member in contact with a surface of the polishing pad, the heating flow passage and the cooling flow passage being formed in the pad contact member; and controlling a flow rate of the heating liquid and a flow rate of the cooling liquid independently based on a surface temperature of the polishing pad.

In an embodiment, the sum of the flow rate of the heating liquid and the flow rate of the cooling liquid is kept constant.

In an embodiment, the heating flow passage and the cooling flow passage extend adjacent to each other and extend in a spiral shape.

According to the above-described embodiments, only a heating liquid flows in the heating flow passage of the pad contact member, and only a cooling liquid flows in the cooling flow passage. The flow rates of the heating liquid and the cooling liquid are controlled based on a surface temperature of a polishing pad. By thus supplying the heating liquid and the cooling liquid through dedicated supply pipes, and controlling the flow rates of the liquids, instead of performing switching between hot water and cold water, analog-like temperature control becomes possible. Therefore, the surface temperature of the polishing pad can be stably maintained at a target temperature.

DESCRIPTION OF EMBODIMENTS

Embodiments will now be described with reference to the drawings.

Figure 1:
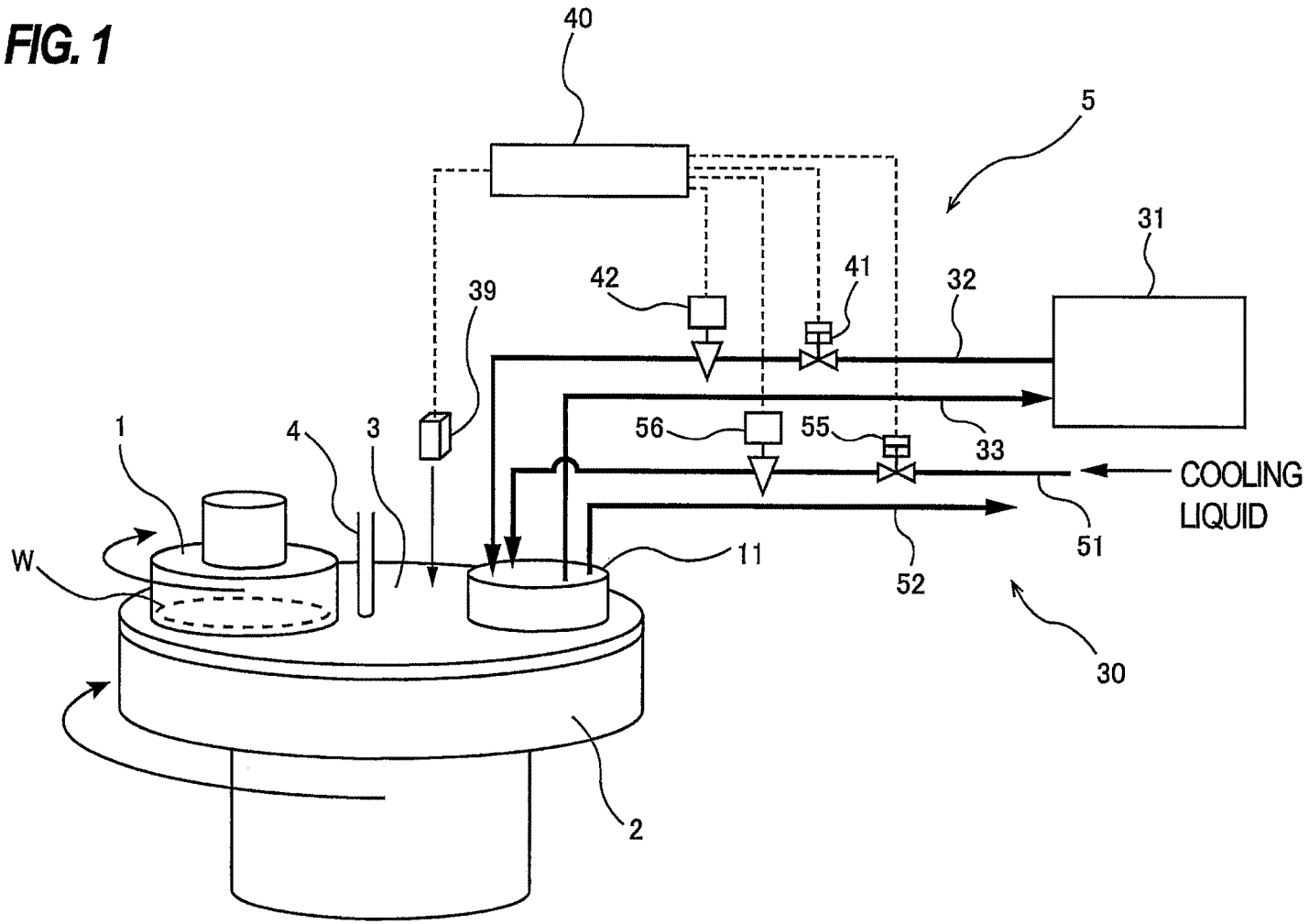
FIG. 1 is a schematic view of a polishing apparatus.

FIG. 1 is a schematic view of a polishing apparatus. As shown in FIG. 1, the polishing apparatus includes a top ring 1 for holding and rotating a wafer W which is an example of a substrate, a polishing table 2 that supports a polishing pad 3, a polishing-liquid supply nozzle 4 for supplying a polishing liquid (e.g. a slurry) onto a surface of the polishing pad 3, and a pad-temperature regulating apparatus 5 for regulating a surface temperature of the polishing pad 3. The surface (upper surface) of the polishing pad 3 provides a polishing surface for polishing the wafer W.

The top ring 1 is vertically movable, and is rotatable about its axis in a direction indicated by arrow. The wafer W is held on a lower surface of the top ring 1 by, for example, vacuum suction. A motor (not shown) is coupled to the polishing table 2, so that the polishing table 2 can rotate in a direction indicated by arrow. As shown in FIG. 1, the top ring 1 and the polishing table 2 rotate in the same direction. The polishing pad 3 is attached to the upper surface of the polishing table 2.

Polishing of the wafer W is performed in the following manner. The wafer W, to be polished, is held by the top ring 1, and is rotated by the top ring 1. The polishing pad 3 is rotated together with the polishing table 2. While the wafer W and the polishing pad 3 are rotating, the polishing liquid is supplied from the polishing-liquid supply nozzle 4 onto the surface of the polishing pad 3, and the surface of the wafer W is then pressed by the top ring 1 against the surface (i.e. the polishing surface) of the polishing pad 3. The surface of the wafer W is polished by the sliding contact with the polishing pad 3 in the presence of the polishing liquid. The surface of the wafer W is planarized by the chemical action of the polishing liquid and the mechanical action of abrasive particles contained in the polishing liquid.

The pad-temperature regulating apparatus 5 includes a pad contact member 11 which can contact the surface of the polishing pad 3, and a liquid supply system 30 for supplying a heating liquid having a regulated temperature and a cooling liquid having a regulated temperature into the pad contact member 11. The liquid supply system 30 includes a heating-liquid supply tank 31 as a heating-liquid supply source for storing the heating liquid having a regulated temperature, and a heating-liquid supply pipe 32 and a heating-liquid return pipe 33, each coupling the heating-liquid supply tank 31 to the pad contact member 11. One ends of the heating-liquid supply pipe 32 and the heating-liquid return pipe 33 are coupled to the heating-liquid supply tank 31, while the other ends are coupled to the pad contact member 11.

The heating liquid having a regulated temperature is supplied from the heating-liquid supply tank 31 to the pad contact member 11 through the heating-liquid supply pipe 32, flows in the pad contact member 11, and is retuned from the pad contact member 11 to the heating-liquid supply tank 31 through the heating-liquid return pipe 33. In this manner, the heating liquid circulates between the heating-liquid supply tank 31 and the pad contact member 11. The heating-liquid supply tank 31 has a heater (not shown in the drawings), so that the heating liquid is heated by the heater to have a predetermined temperature.

A first on-off valve 41 and a first flow control valve 42 are attached to the heating-liquid supply pipe 32. The first flow control valve 42 is located between the pad contact member 11 and the first on-off valve 41. The first on-off valve 41 is a valve not having a flow rate regulating function, whereas the first flow control valve 42 is a valve having a flow rate regulating function.

The liquid supply system 30 further includes a cooling-liquid supply pipe 51 and a cooling-liquid discharge pipe 52, both coupled to the pad contact member 11. The cooling-liquid supply pipe 51 is coupled to a cooling-liquid supply source (e.g. a cold water supply source) provided in a factory in which the polishing apparatus is installed. The cooling liquid is supplied to the pad contact member 11 through the cooling-liquid supply pipe 51, flows in the pad contact member 11, and is drained from the pad contact member 11 through the cooling-liquid discharge pipe 52. In one embodiment, the cooling liquid that has flowed through the pad contact member 11 may be returned to the cooling-liquid supply source through the cooling-liquid discharge pipe 52.

A second on-off valve 55 and a second flow control valve 56 are attached to the cooling-liquid supply pipe 51. The second flow control valve 56 is located between the pad contact member 11 and the second on-off valve 55. The second on-off valve 55 is a valve not having a flow rate regulating function, whereas the second flow control valve 56 is a valve having a flow rate regulating function.

The pad-temperature regulating apparatus 5 further includes a pad-temperature measuring device 39 for measuring a surface temperature of the polishing pad 3 (which may hereinafter be referred to as pad surface temperature), and a valve controller 40 for operating the first flow control valve 42 and the second flow control valve 56 based on the pad surface temperature measured by the pad-temperature measuring device 39. The first on-off valve 41 and the second on-off valve 55 are usually open. A radiation thermometer, which can measure the surface temperature of the polishing pad 3 in a non-contact manner, can be used as the pad-temperature measuring device 39.

The pad-temperature measuring device 39 measures the surface temperature of the polishing pad 3 in a non-contact manner, and sends the measured value of the surface temperature to the valve controller 40. Based on the pad surface temperature measured, the valve controller 40 operates the first flow control valve 42 and the second flow control valve 56 to control the flow rates of the heating liquid and the cooling liquid so that the pad surface temperature is maintained at a preset target temperature. The first flow control valve 42 and the second flow control valve 56 operate according to control signals from the valve controller 40 and regulate the flow rates of the heating liquid and the cooling liquid to be supplied to the pad contact member 11. Heat exchange occurs between the polishing pad 3 and the heating liquid and cooling liquid, flowing in the pad contact member 11, whereby the pad surface temperature changes.

Such feedback control can maintain the surface temperature of the polishing pad 3 (i.e., the pad surface temperature) at a predetermined target temperature. A PID controller may be used as the valve controller 40. The target temperature of the polishing pad 3 is determined depending on the type of the wafer W or on the polishing process, and the determined target temperature is inputted into the valve controller 40 in advance.

In order to maintain the pad surface temperature at the predetermined target temperature, the pad contact member 11 is placed in contact with the surface (i.e. the polishing surface) of the polishing pad 3 during polishing of the wafer W. In this specification, the manner of contact of the pad contact member 11 with the surface of the polishing pad 3 includes not only direct contact of the pad contact member 11 with the surface of the polishing pad 3, but also contact of the pad contact member 11 with the surface of the polishing pad 3 in the presence of a polishing liquid (or slurry) between the pad contact member 11 and the surface of the polishing pad 3. In either case, heat exchange occurs between the polishing pad 3 and the heating liquid and cooling liquid, flowing in the pad contact member 11, whereby the pad surface temperature is controlled.

Hot water may be used as the heating liquid to be supplied to the pad contact member 11. The hot water that has been heated to about 80° C. by the heater of the heating-liquid supply tank 31 may be used. When it is intended to raise the surface temperature of the polishing pad 3 more quickly, a silicone oil may be used as the heating liquid. In the case of using a silicone oil as the heating liquid, the silicone oil may be heated to a temperature of not less than 100° C. (e.g. about 120° C.). Cold water or a silicone oil may be used as the cooling liquid to be supplied to the pad contact member 11. In the case of using a silicone oil as the cooling liquid, the polishing pad 3 can be cooled quickly by coupling a chiller as a cooling-liquid supply source to the cooling-liquid supply pipe 51, and by cooling the silicone oil to a temperature of not more than 0° C. Pure water can be used as the cold water. In order to cool pure water to produce cold water, a chiller may be used as a cooling-liquid supply source. In this case, cold water that has flowed through the pad contact member 11 may be returned to the chiller through the cooling-liquid discharge pipe 52.

The heating-liquid supply pipe 32 and the cooling-liquid supply pipe 51 are completely independent pipes. Thus, the heating liquid and the cooling liquid can be simultaneously supplied to the pad contact member 11 without mixing with each other. The heating-liquid return pipe 33 and the cooling-liquid discharge pipe 52 are also completely independent pipes. Thus, the heating liquid is returned to the heating-liquid supply tank 31 without mixing with the cooling liquid, while the cooling liquid is either drained or returned to the cooling-liquid supply source without mixing with the heating liquid.

Figure 2:
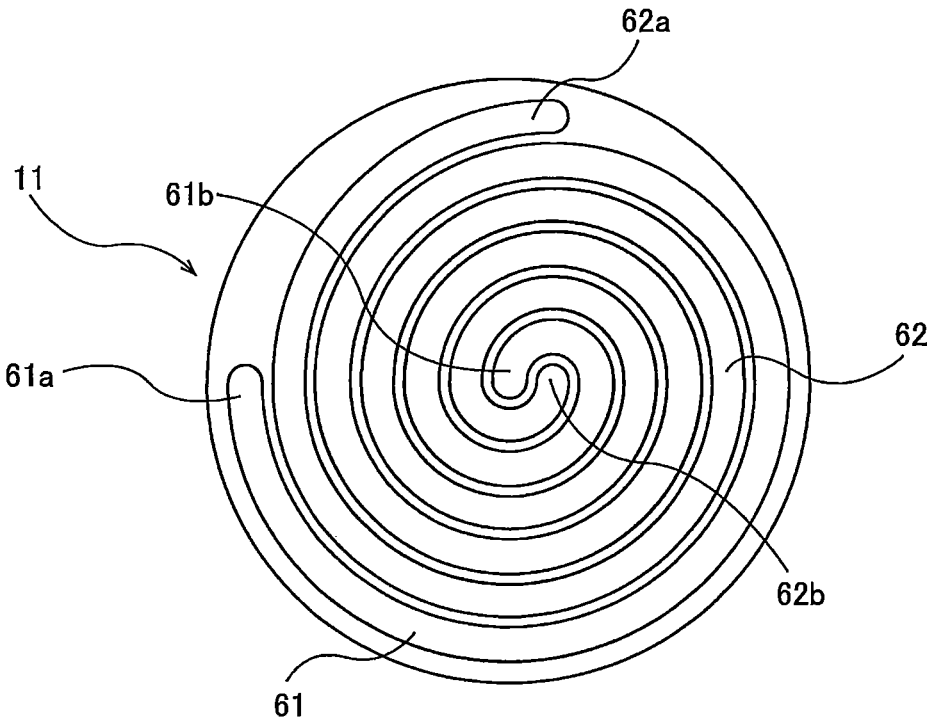
FIG. 2 is a horizontal cross-sectional view of a pad contact member.

The pad contact member 11 will now be described with reference to FIG. 2. FIG. 2 is a horizontal cross-sectional view of the pad contact member 11. As shown in FIG. 2, the pad contact member 11 has, in its interior, a heating flow passage 61 and a cooling flow passage 62. The heating flow passage 61 and the cooling flow passage 62 extend adjacent to each other (or side by side) and extend in a spiral shape. In this embodiment the heating flow passage 61 is shorter than the cooling flow passage 62.

The heating-liquid supply pipe 32 is coupled to an inlet 61*a* of the heating flow passage 61, while the heating-liquid return pipe 33 is coupled to an outlet 61*b* of the heating flow passage 61. The cooling-liquid supply pipe 51 is coupled to an inlet 62*a* of the cooling flow passage 62, while the cooling-liquid discharge pipe 52 is coupled to an outlet 62*b* of the cooling flow passage 62. The inlets 61*a*, 62*a* of the heating flow passage 61 and the cooling flow passage 62 are located at a peripheral portion of the pad contact member 11, while the outlets 61*b*, 62*b* of the heating flow passage 61 and the cooling flow passage 62 are located at a central portion of the pad contact member 11. Accordingly, the heating liquid and the cooling liquid flow spirally from the peripheral portion toward the central portion of the pad contact member 11. The heating flow passage 61 and the cooling flow passage 62 are completely separated from each other, and therefore the heating liquid and the cooling liquid are not mixed with each other in the pad contact member 11.

Figure 3:
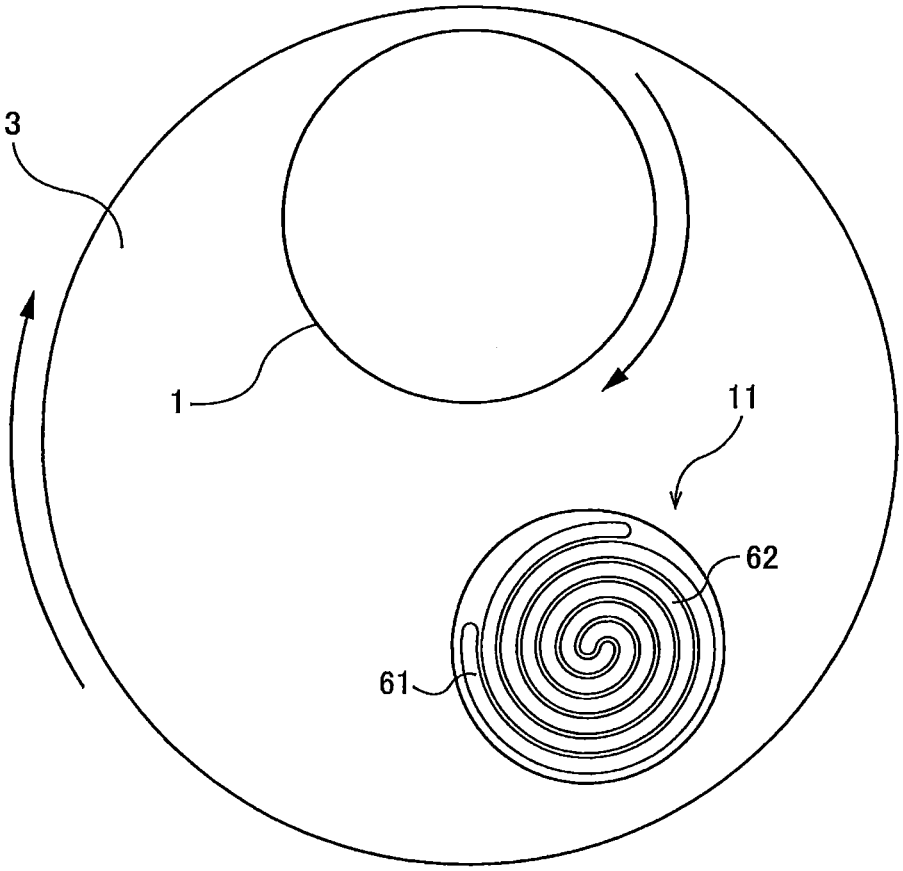
FIG. 3 is a plan view showing a positional relationship between the pad contact member and a top ring on a polishing pad.

FIG. 3 is a plan view showing a positional relationship between the pad contact member 11 and the top ring 1 on the polishing pad 3. The pad contact member 11 has a circular shape when viewed from above, and has a diameter which is smaller than the diameter of the top ring 1. A distance from the center of rotation of the polishing pad 3 to the center of the pad contact member 11 is equal to a distance from the center of rotation of the polishing pad 3 to the center of the top ring 1. Since the heating flow passage 61 and the cooling flow passage 62 are adjacent to each other, the heating flow passage 61 and the cooling flow passage 62 are arranged not only along the radial direction of the polishing pad 3 but also along the circumferential direction of the polishing pad 3. Therefore, while the polishing table 2 and the polishing pad 3 are rotating, the polishing pad 3 in contact with the pad contact member 11 performs the heat exchange with both of the heating liquid and the cooling liquid.

Figure 4:
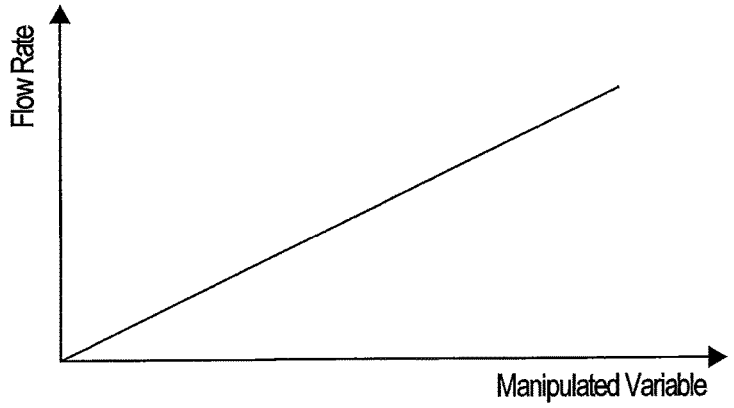
FIG. 4 is a graph showing a relationship between flow rate and manipulated variable for a first flow control valve and a second flow control valve.

The valve controller 40 is configured to determine a manipulated variable for the first flow control valve 42 and a manipulated variable for the second flow control valve 56 which are necessary to eliminate a difference between a preset target temperature and a measured surface temperature of the polishing pad 3. The manipulated variable for the first flow control valve 42 and the manipulated variable for the second flow control valve 56 are, in other words, the degree of opening of the valve. The manipulated variable for the first flow control valve 42 is proportional to the flow rate of the heating liquid, and the manipulated variable for the second flow control valve 56 is proportional to the flow rate of the cooling liquid. Preferably, as shown in FIG. 4, the manipulated variable for the first flow control valve 42 is directly proportional to the flow rate of the heating liquid, and the manipulated variable for the second flow control valve 56 is directly proportional to the flow rate of the cooling liquid.

Figure 5:
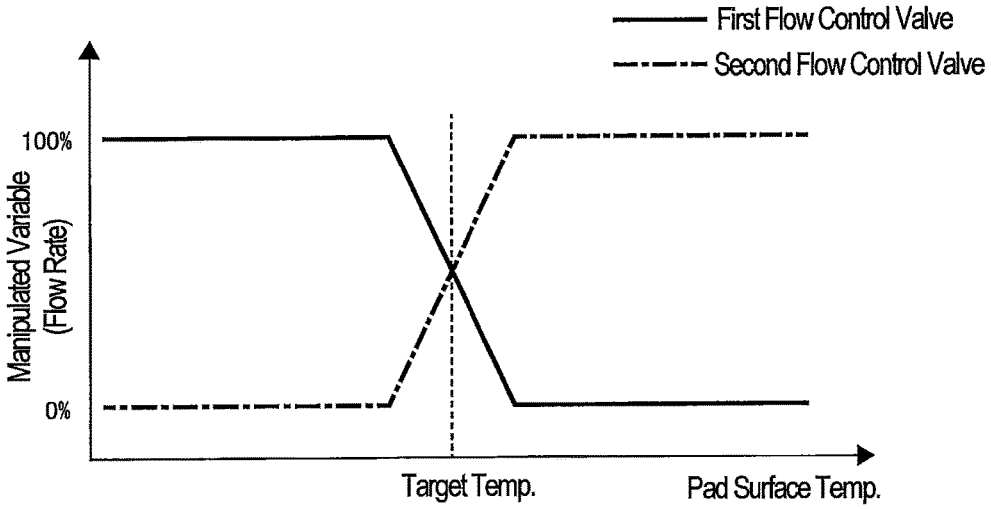
FIG. 5 is a diagram illustrating operation of a valve controller.

FIG. 5 is a diagram illustrating the operation of the valve controller 40. Where the manipulated variable for the first flow control valve 42 and the manipulated variable for the second flow control valve 56 are each expressed as a numerical value ranging from 0% to 100%, the valve controller 40 is configured to determine the manipulated variable for the second flow control valve 56 by subtracting the manipulated variable for the first flow control valve 42 from 100%. In one embodiment, the valve controller 40 may be configured to determine the manipulated variable for the first flow control valve 42 by subtracting the manipulated variable for the second flow control valve 56 from 100%.

When the manipulated variable for the first flow control valve 42 is 100%, it indicates that the first flow control valve 42 is fully open. When the manipulated variable for the first flow control valve 42 is 0%, it indicates that the first flow control valve 42 is fully closed. Similarly, when the manipulated variable for the second flow control valve 56 is 100%, it indicates that the second flow control valve 56 is fully open; when the manipulated variable for the second flow control valve 56 is 0%, it indicates that the second flow control valve 56 is fully closed.

The flow rate of the heating liquid when the manipulated variable for the first flow control valve 42 is 100% is equal to the flow rate of the cooling liquid when the manipulated variable for the second flow control valve 56 is 100%. Accordingly, the sum of the flow rate of the heating liquid passing through the first flow control valve 42 and the flow rate of the cooling liquid passing through the second flow control valve 56 is constant at all times.

Figure 6:
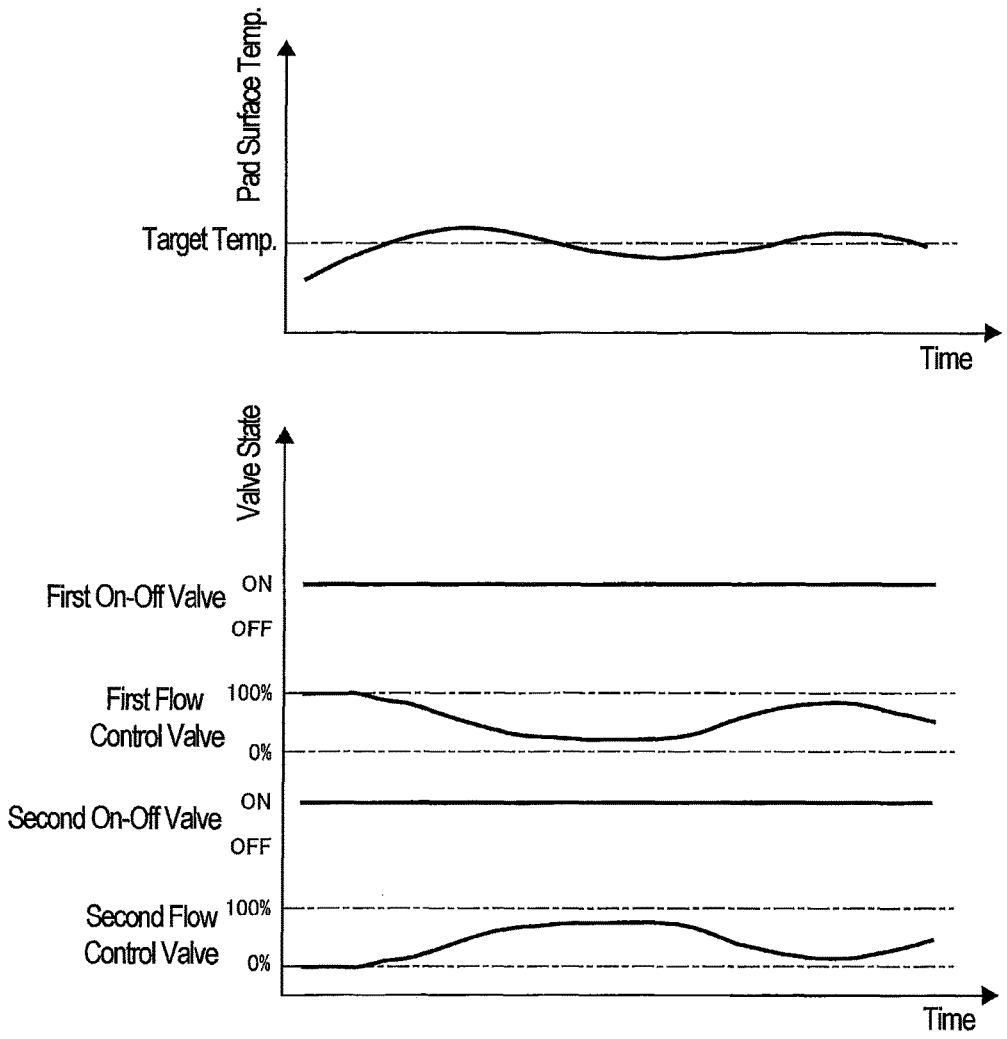
FIG. 6 is a graph showing change in pad surface temperature and states of valves.

FIG. 6 is a graph showing change in the pad surface temperature and the states of the valves. As shown in FIG. 6, the first flow control valve 42 and the second flow control valve 56 are operated in such a manner that the sum of the manipulated variable for the first flow control valve 42 and the manipulated variable for the second flow control valve 56 is 100%. Since the sum of the flow rate of the heating liquid and the flow rate of the cooling liquid is kept constant, hunting of the pad surface temperature can be prevented.

According to this embodiment, only the heating liquid flows in the heating flow passage 61 of the pad contact member 11, and only the cooling liquid flows in the cooling flow passage 62. The flow rates of the heating liquid and the cooling liquid are controlled based on the surface temperature of the polishing pad 3. In particular, the first flow control valve 42 and the second flow control valve 56 are operated based on the difference between the surface temperature of the polishing pad 3 and a target temperature. The surface temperature of the polishing pad 3 can therefore be stably maintained at the target temperature.

Figure 7:
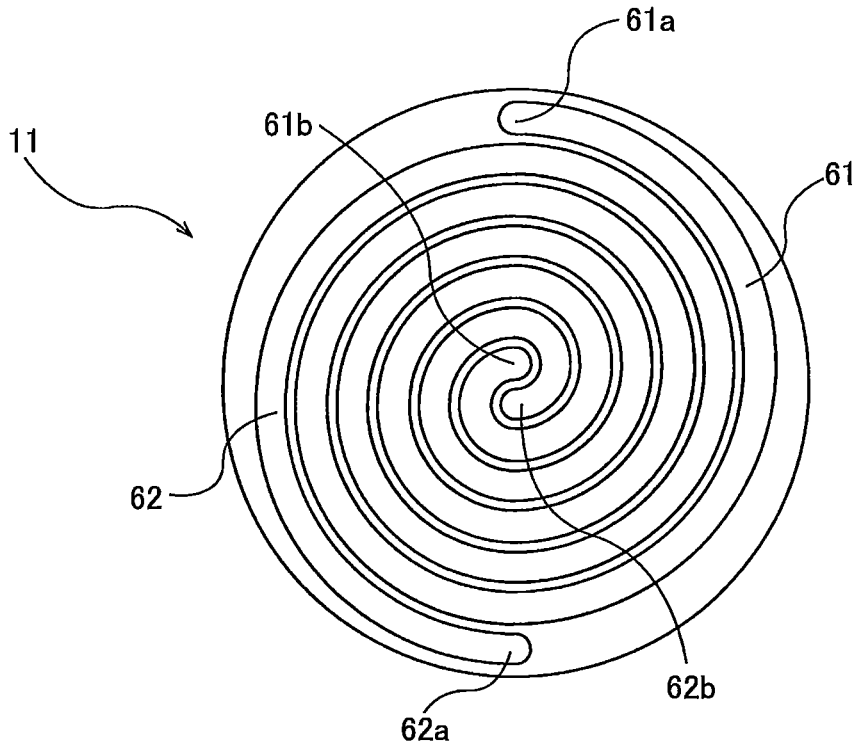
FIG. 7 is a horizontal cross-sectional view of another embodiment of a pad contact member.
Figure 8:
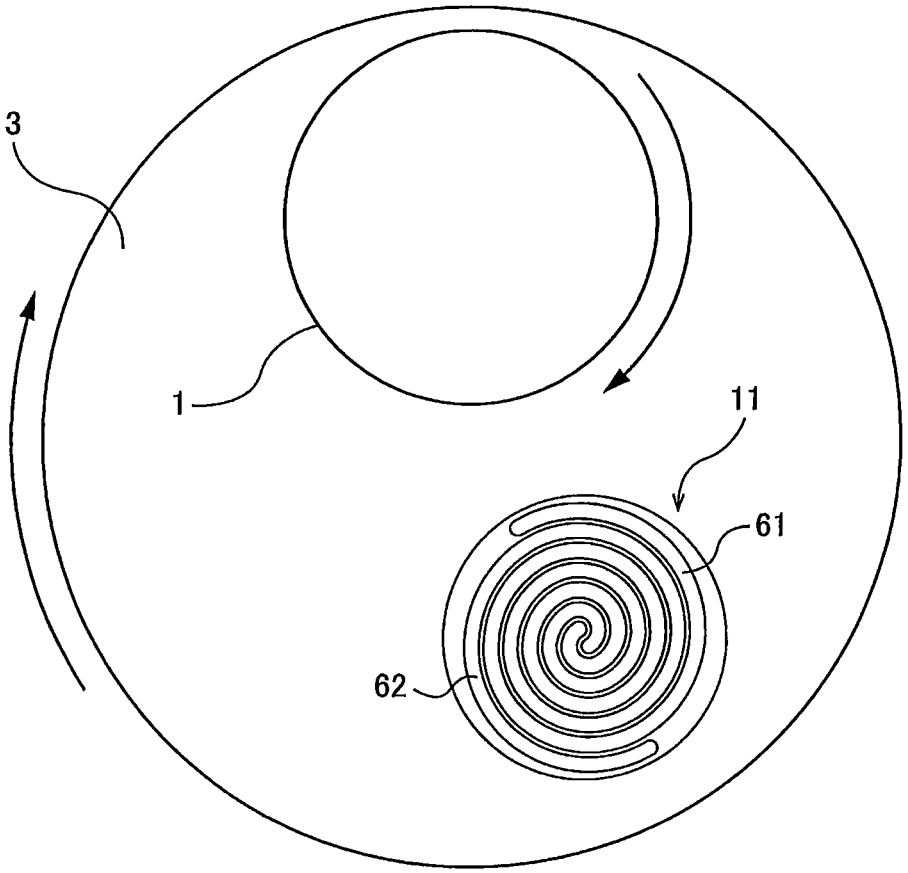
FIG. 8 is a plan view showing a positional relationship between the pad contact member shown in FIG. 7 and a top ring.

FIG. 7 is a horizontal cross-sectional view of another embodiment of pad contact member 11, and FIG. 8 is a plan view showing a positional relationship between the pad contact member 11 shown in FIG. 7 and the top ring 1. As with the embodiment shown in FIG. 2, the heating flow passage 61 and the cooling flow passage 62 extend adjacent to each other (or side by side) and extend in a spiral shape. Further, the heating flow passage 61 and the cooling flow passage 62 are point-symmetrical and have the same length.

Figure 9:
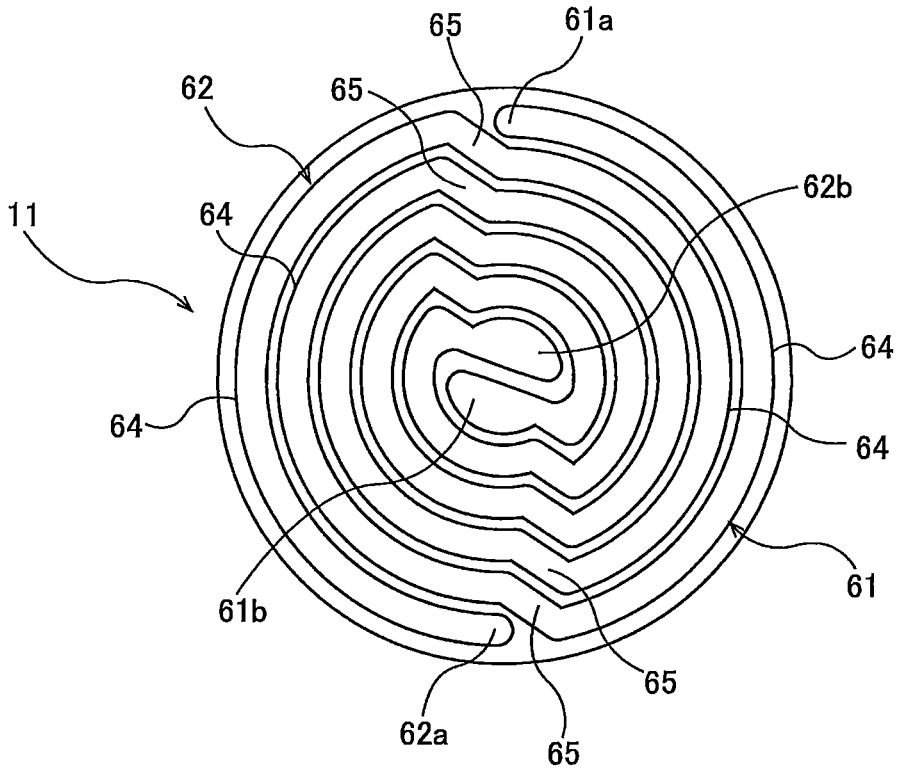
FIG. 9 is a horizontal cross-sectional view of yet another embodiment of a pad contact member.
Figure 10:
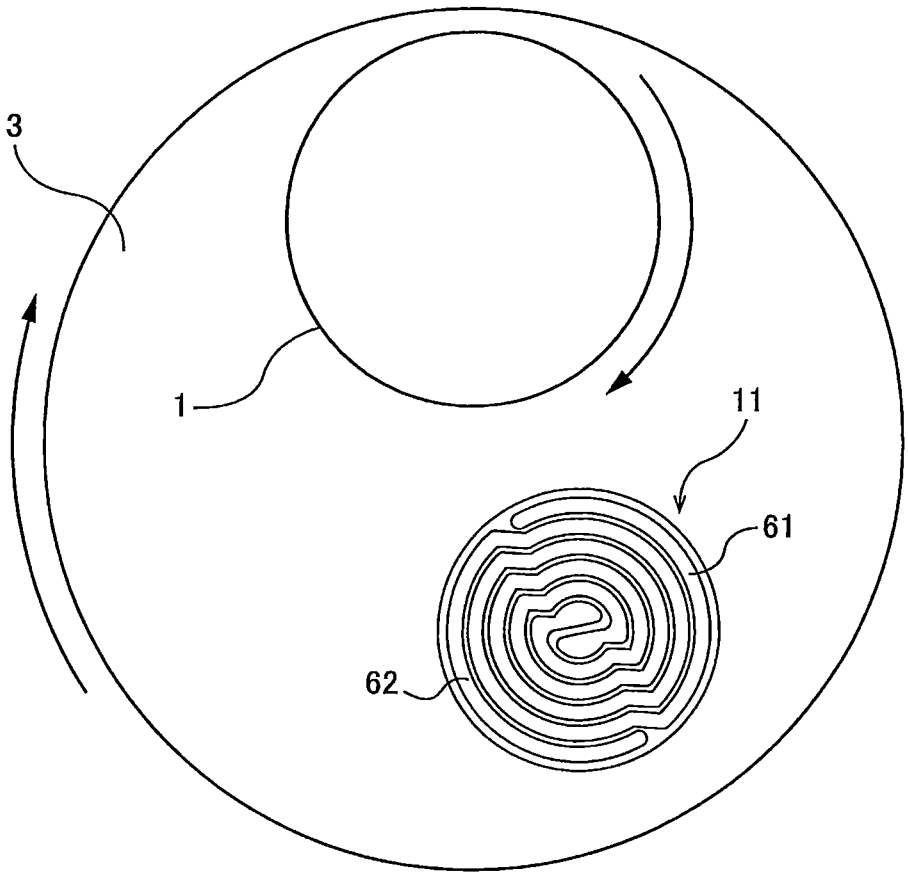
FIG. 10 is a plan view showing a positional relationship between the pad contact member shown in FIG. 9 and a top ring.

FIG. 9 is a horizontal cross-sectional view of yet another embodiment of pad contact member 11, and FIG. 10 is a plan view showing a positional relationship between the pad contact member 11 shown in FIG. 9 and the top ring 1. As with the embodiment shown in FIG. 2, the heating flow passage 61 and the cooling flow passage 62 extend adjacent to each other (or side by side) and extend in a spiral shape. Further, the heating flow passage 61 and the cooling flow passage 62 are point-symmetrical and have the same length.

As shown in FIG. 9, the heating flow passage 61 and the cooling flow passage 62 are each basically composed of a plurality of arc-shaped flow passages 64 having a constant curvature, and a plurality of oblique flow passages 65 coupling the arc-shaped flow passages 64. Two adjacent arc-shaped flow passages 64 are coupled to each other by each oblique flow passage 65. Such a construction makes it possible to locate the outermost portions of the heating flow passage 61 and the cooling flow passage 62 at an outermost portion of the pad contact member 11. Specifically, most of the pad contact surface, i.e. the lower surface, of the pad contact member 11 lies under the heating flow passage 61 and the cooling flow passage 62. Therefore, the heating liquid and the cooling liquid can quickly heat and cool the surface of the polishing pad 3.

Figure 11:
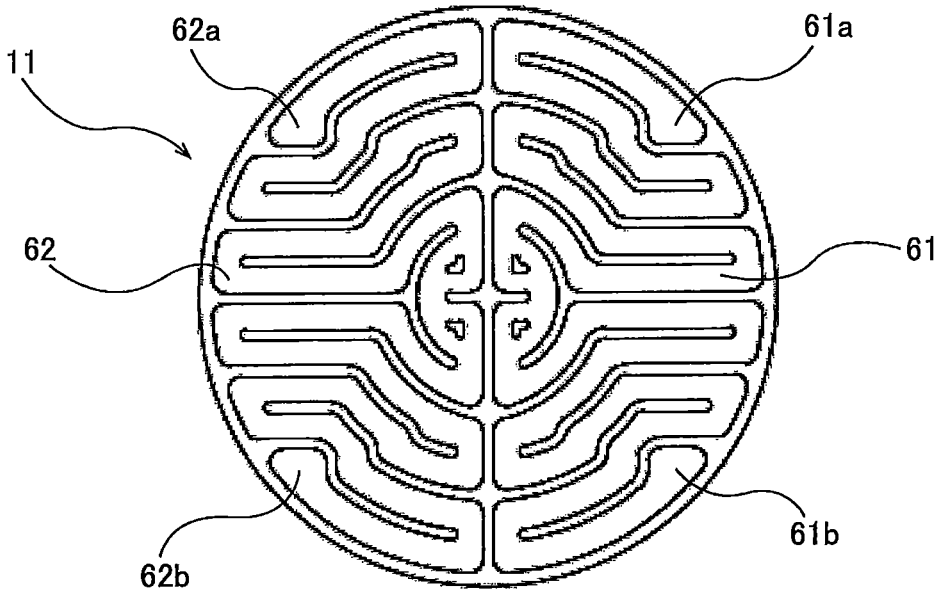
FIG. 11 is a horizontal cross-sectional view of yet another embodiment of a pad contact member.
Figure 12:
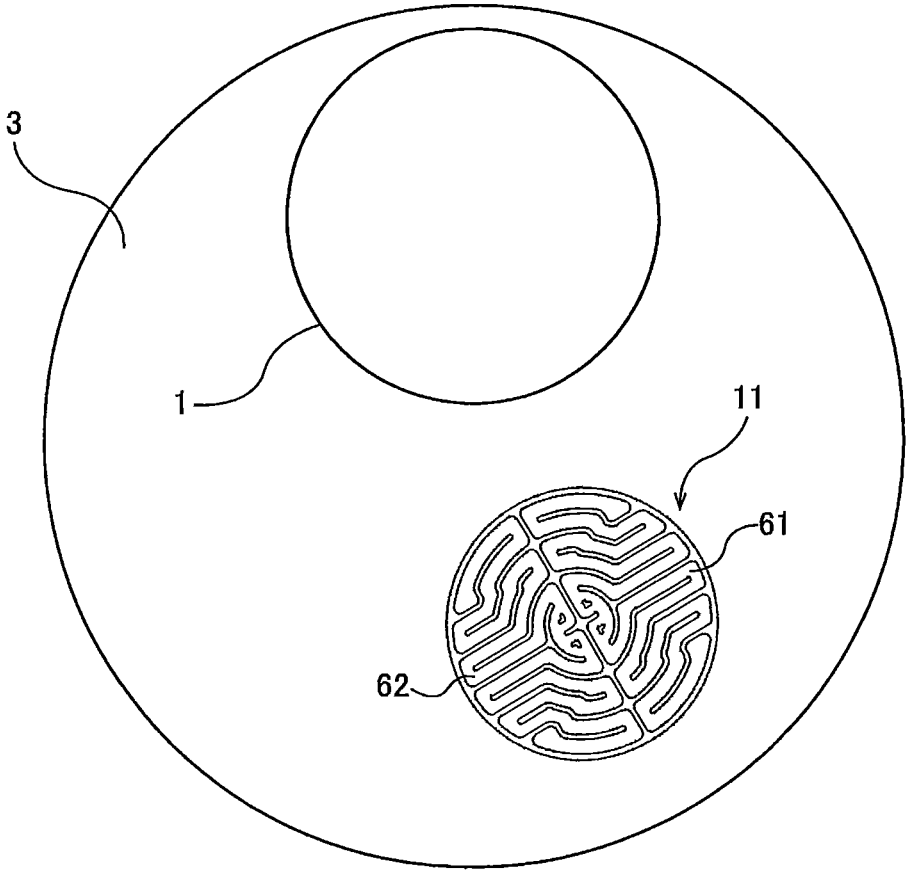
FIG. 12 is a plan view showing a positional relationship between the pad contact member shown in FIG. 11 and a top ring.

FIG. 11 is a horizontal cross-sectional view of yet another embodiment of pad contact member 11, and FIG. 12 is a plan view showing a positional relationship between the pad contact member 11 shown in FIG. 11 and the top ring 1. The heating flow passage 61 and the cooling flow passage 62 are each composed of a labyrinthine passage disposed in a semicircular area. The heating flow passage 61 and the cooling flow passage 62 are symmetrical with respect to a radial direction of the polishing pad 3. The heating flow passage 61 and the cooling flow passage 62 are arranged along the circumferential direction of the polishing pad 3. Therefore, when the polishing table 2 is rotating, the two semicircular areas in which the heating flow passage 61 and the cooling flow passage 62 are located make contact with the same area in the surface of the polishing pad 3.

Figure 13:
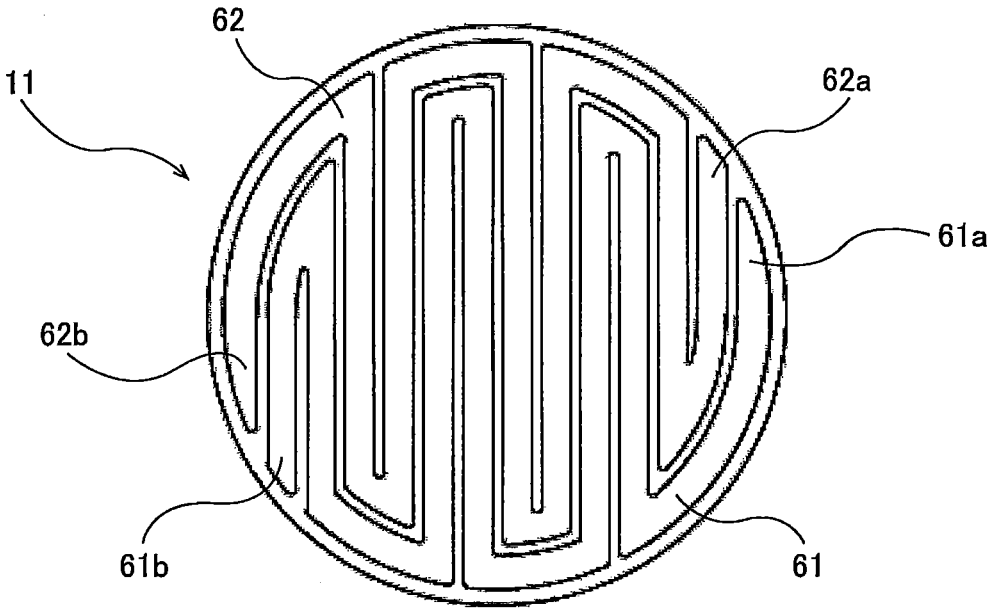
FIG. 13 is a horizontal cross-sectional view of yet another embodiment of a pad contact member.
Figure 14:
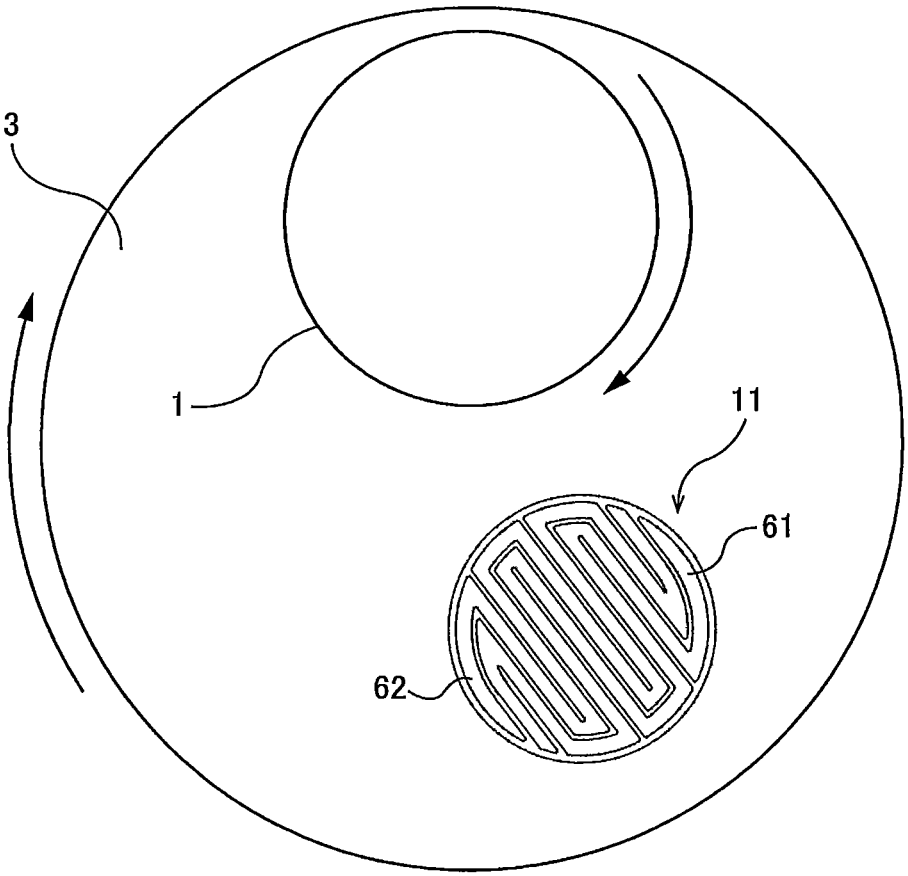
FIG. 14 is a plan view showing a positional relationship between the pad contact member shown in FIG. 13 and a top ring.

FIG. 13 is a horizontal cross-sectional view of yet another embodiment of pad contact member 11, and FIG. 14 is a plan view showing a positional relationship between the pad contact member 11 shown in FIG. 13 and the top ring 1. The heating flow passage 61 and the cooling flow passage 62 extend adjacent to each other (or side by side) and extend in a zigzag manner. Further, the heating flow passage 61 and the cooling flow passage 62 are point-symmetrical and have the same length. Also in this embodiment, the heating flow passage 61 and the cooling flow passage 62 are arranged along the circumferential direction of the polishing pad 3.

Figure 15:
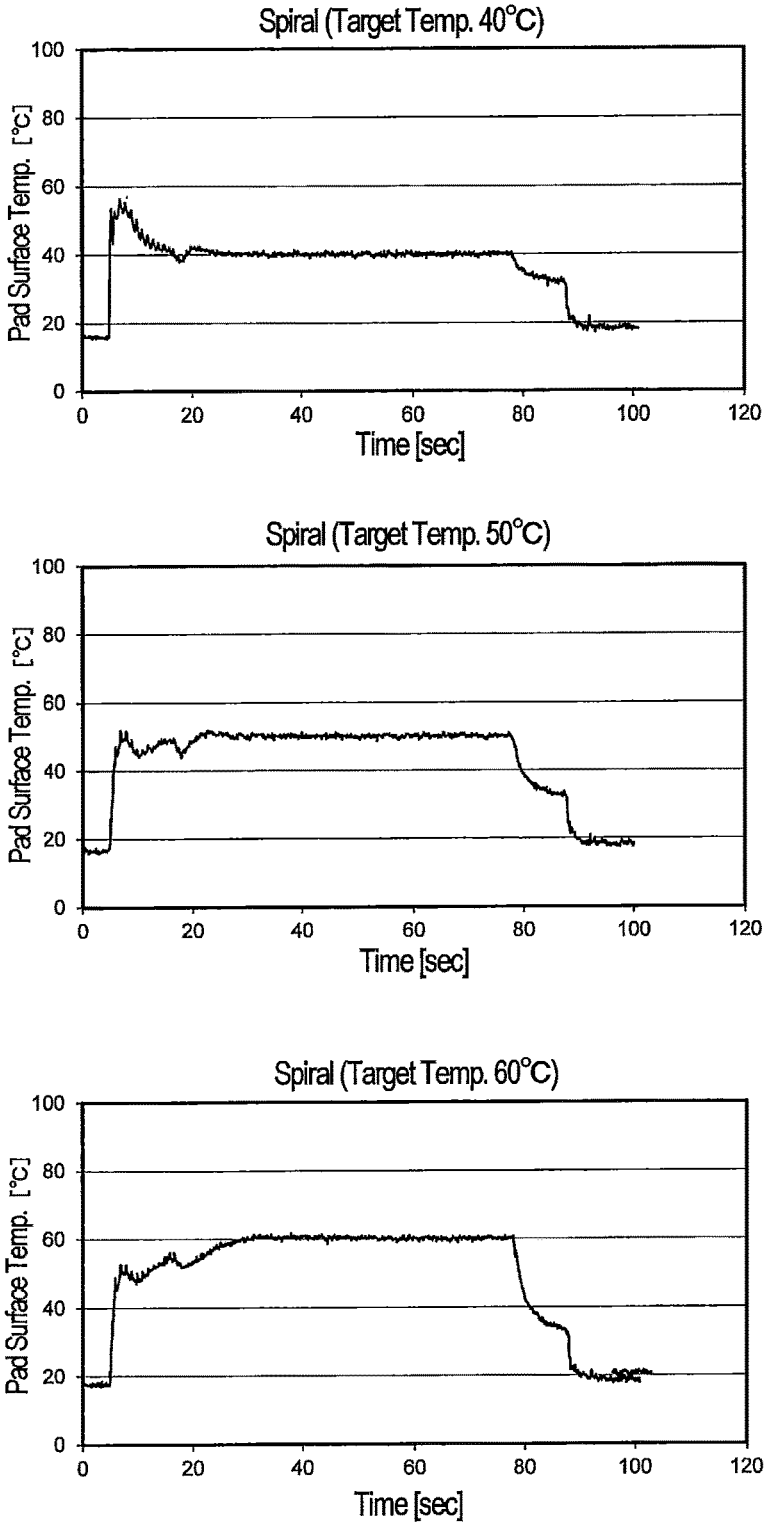
FIG. 15 shows experimental data on change in pad surface temperature as observed when the pad contact member shown in FIG. 2, having a spiral heating flow passage and a spiral cooling flow passage, was placed in contact with a polishing pad.

FIG. 15 shows experimental data on change in the pad surface temperature as observed when the pad contact member 11 shown in FIG. 2, having the spiral heating flow passage 61 and the spiral cooling flow passage 62, was placed in contact with the polishing pad 3. In this experiment, the first flow control valve 42 and the second flow control valve 56 were operated in such a manner that the sum of the manipulated variable for the first flow control valve 42 and the manipulated variable for the second flow control valve 56 was 100%. The target temperatures were 40° C., 50° C., 60° C. As can be seen in FIG. 15, the surface temperature of the polishing pad 3 was maintained at the respective target temperature without causing significant hunting.

Figure 16:
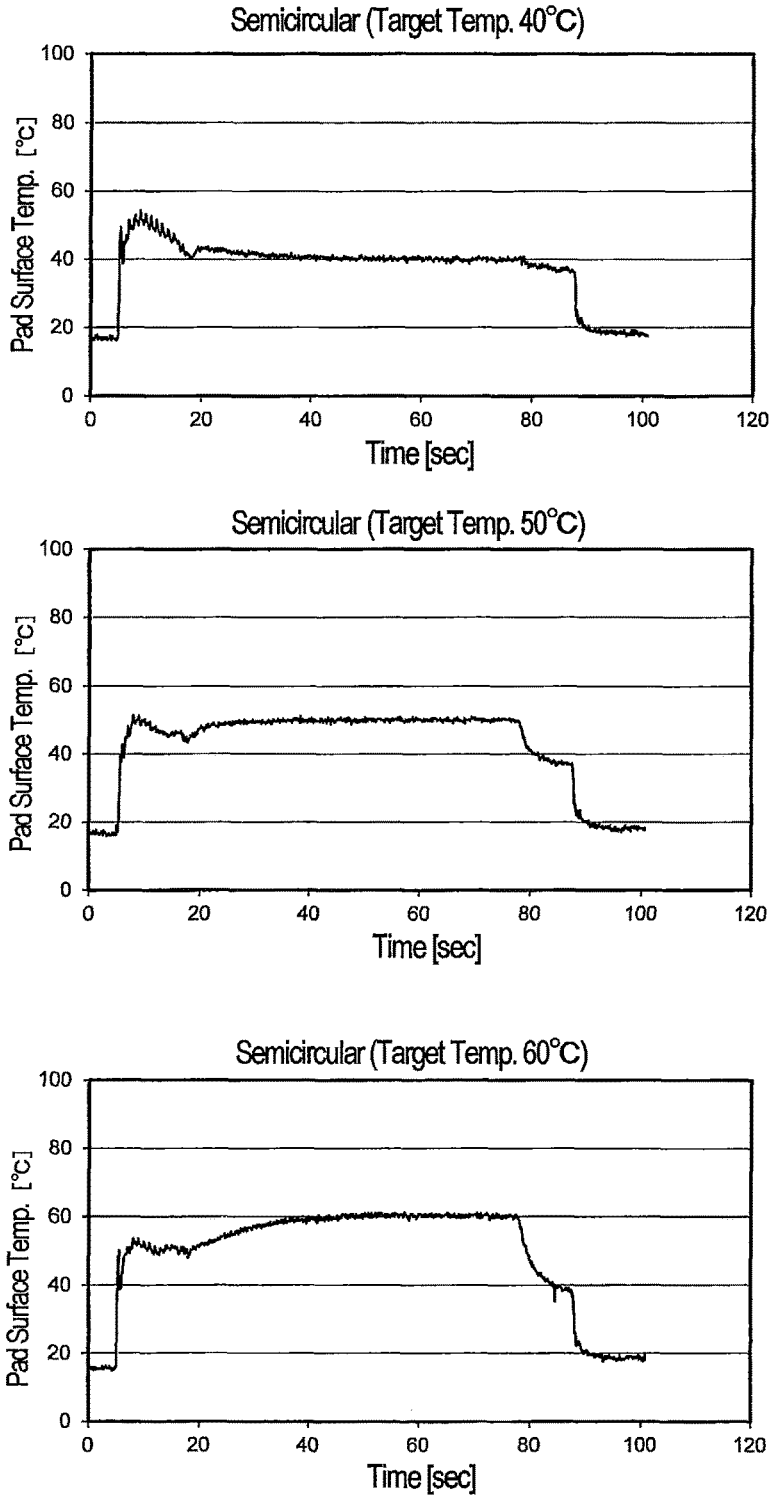
FIG. 16 shows experimental data on change in pad surface temperature as observed when the pad contact member shown in FIG. 11, having a heating flow passage and a cooling flow passage each extending in a semicircular shape, was placed in contact with a polishing pad.

FIG. 16 shows experimental data on change in the pad surface temperature as observed when the pad contact member 11 shown in FIG. 11, having the heating flow passage 61 and the cooling flow passage 62 each extending in a semicircular shape, was placed in contact with the polishing pad 3. Also in this experiment, the first flow control valve 42 and the second flow control valve 56 were operated in such a manner that the sum of the manipulated variable for the first flow control valve 42 and the manipulated variable for the second flow control valve 56 was 100%. The target temperatures were 40° C., 50° C., 60° C. As can be seen in FIG. 16, the surface temperature of the polishing pad 3 was maintained at the respective target temperature without causing significant hunting.

Figure 17:
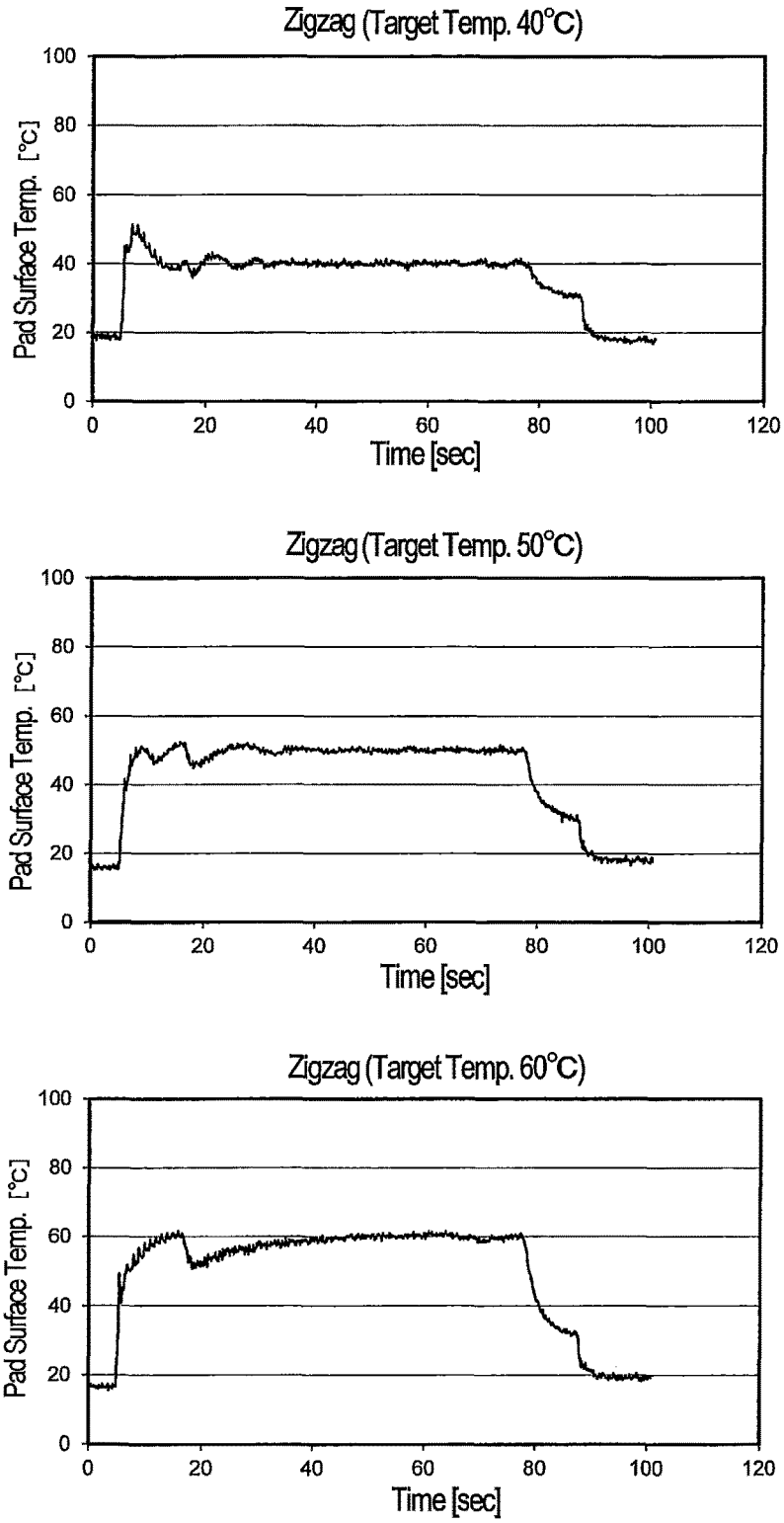
FIG. 17 shows experimental data on change in pad surface temperature as observed when the pad contact member shown in FIG. 13, having a zigzag heating flow passage and a zigzag cooling flow passage, was placed in contact with a polishing pad.

FIG. 17 shows experimental data on change in the pad surface temperature as observed when the pad contact member 11 shown in FIG. 13, having the zigzag heating flow passage 61 and the zigzag cooling flow passage 62, was placed in contact with the polishing pad 3. Also in this experiment, the first flow control valve 42 and the second flow control valve 56 were operated in such a manner that the sum of the manipulated variable for the first flow control valve 42 and the manipulated variable for the second flow control valve 56 was 100%. The target temperatures were 40° C., 50° C., 60° C. As can be seen in FIG. 17, the surface temperature of the polishing pad 3 was maintained at the respective target temperature without causing significant hunting.

Figure 18:
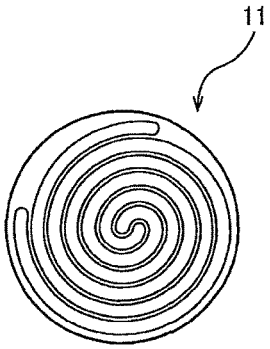
FIG. 18 is a graph showing a distribution of the pad surface temperature as observed when the pad contact member shown in FIG. 2, having the spiral heating flow passage and the spiral cooling flow passage, was placed in contact with a polishing pad.
Figure 18:
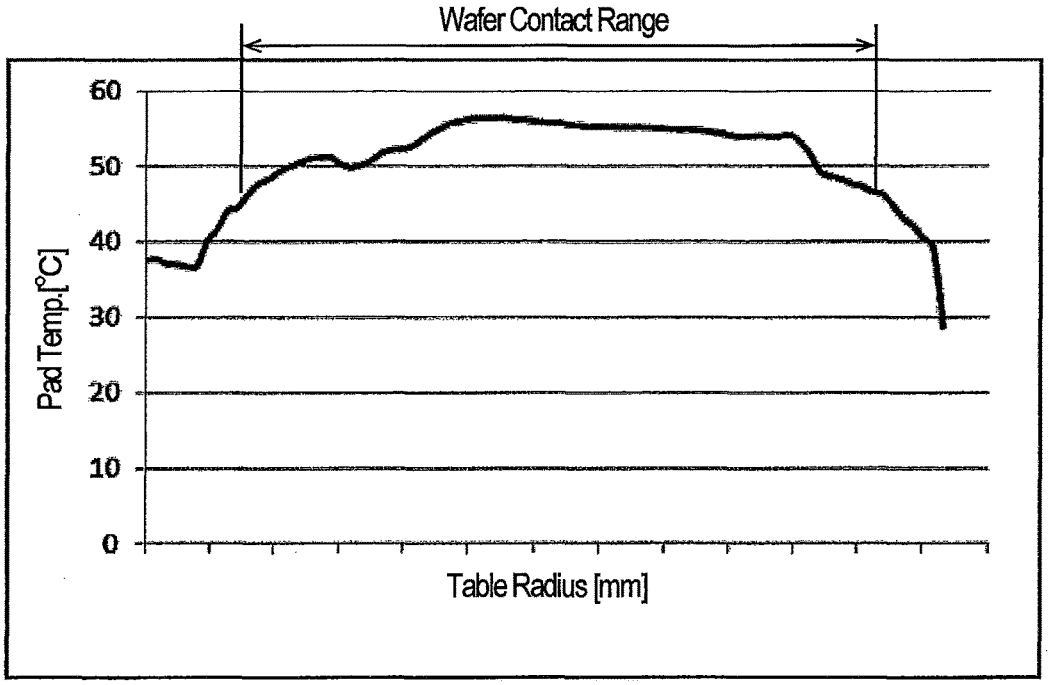
Figure 19:
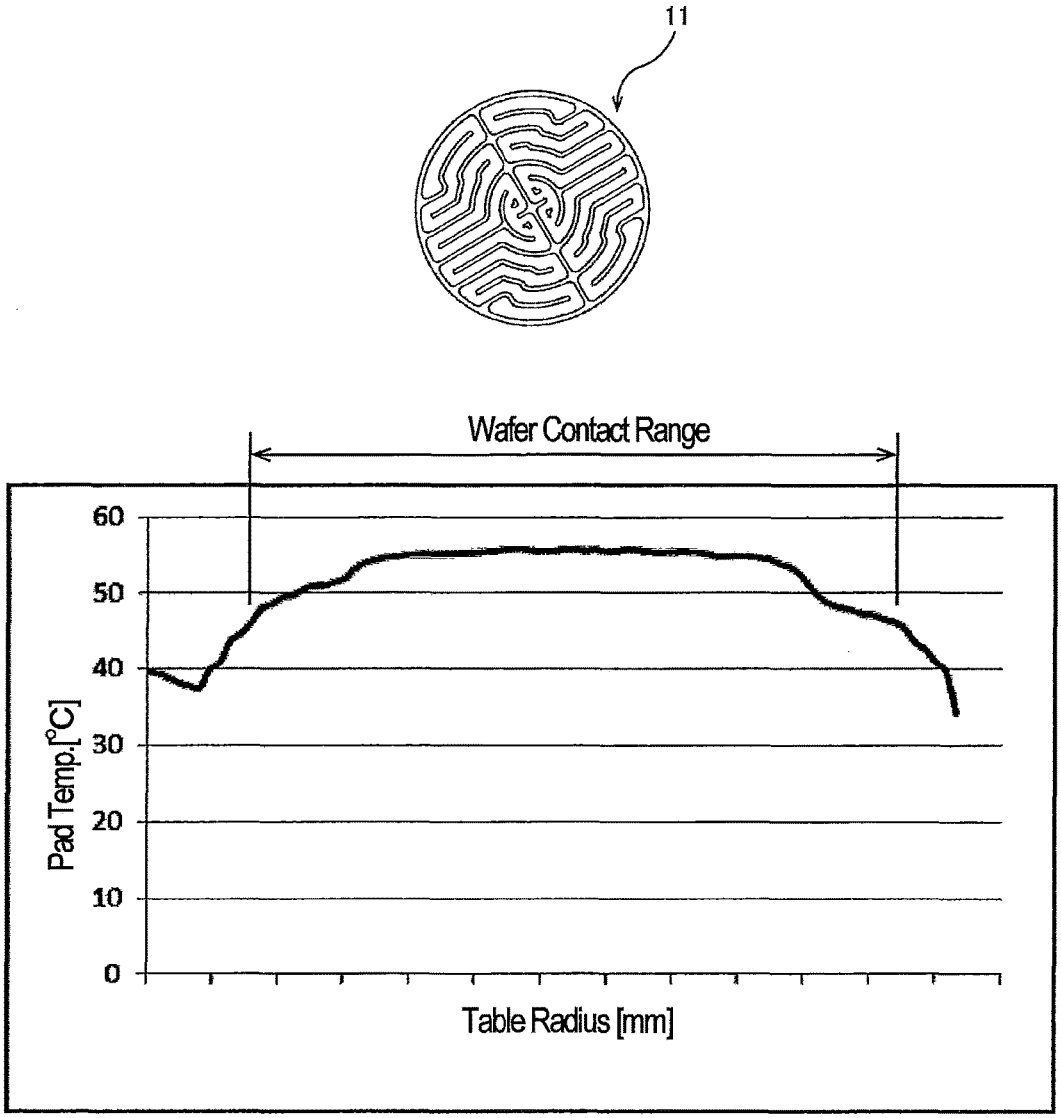
FIG. 19 is a graph showing a distribution of the pad surface temperature as observed when the pad contact member shown in FIG. 11, having the heating flow passage and the cooling flow passage each extending in a semicircular shape, was placed in contact with a polishing pad.
Figure 20:
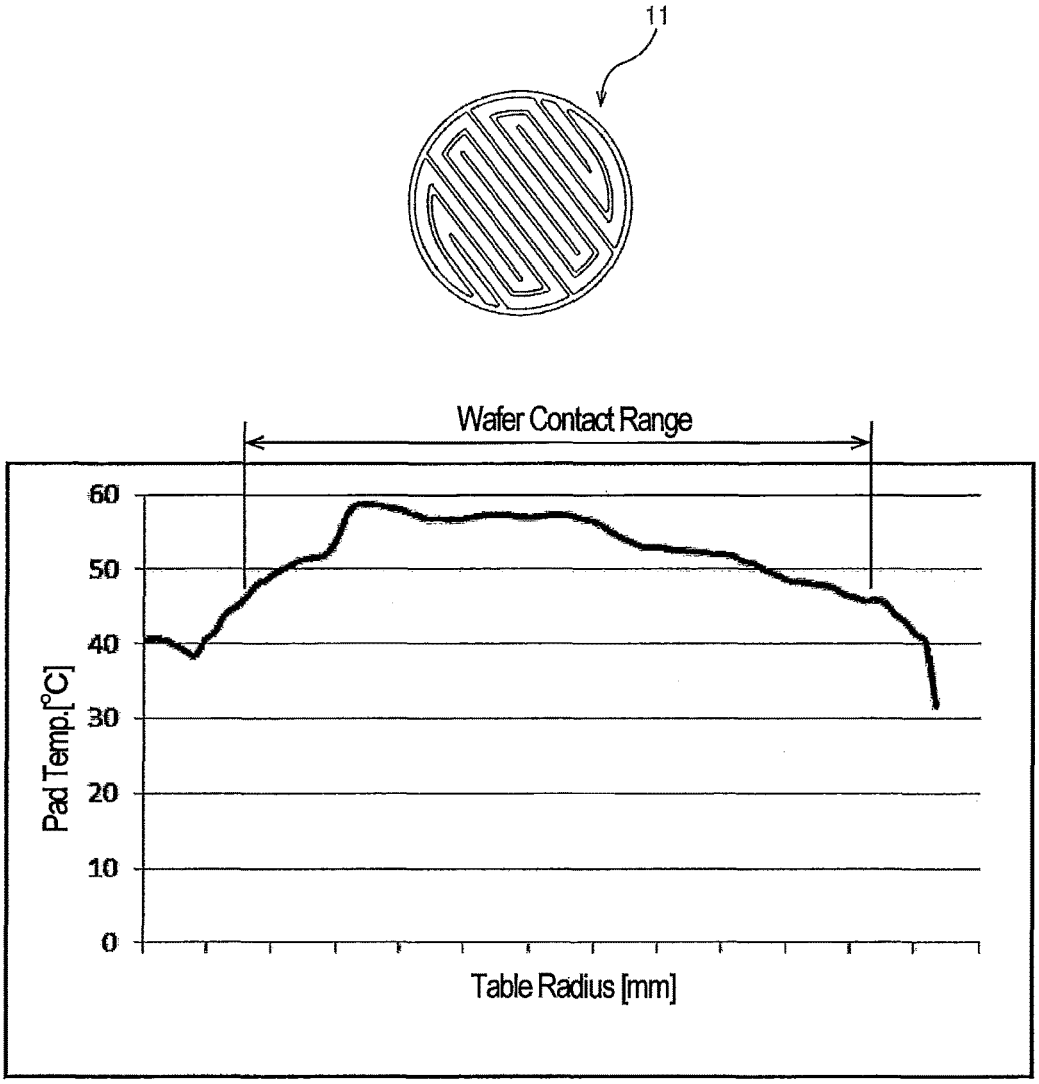
FIG. 20 is a graph showing a distribution of the pad surface temperature as observed when the pad contact member shown in FIG. 13, having the zigzag heating flow passage and the zigzag cooling flow passage, was placed in contact with a polishing pad.

Results of an experiment which was conducted to examine the uniformity of the pad surface temperature will now be described. FIG. 18 is a graph showing a distribution of the pad surface temperature as observed when the pad contact member 11 shown in FIG. 2, having the spiral heating flow passage 61 and the spiral cooling flow passage 62, was in contact with the polishing pad 3. FIG. 19 is a graph showing a distribution of the pad surface temperature as observed when the pad contact member 11 shown in FIG. 11, having the heating flow passage 61 and the cooling flow passage 62 each extending in a semicircular shape, was in contact with the polishing pad 3. FIG. 20 is a graph showing a distribution of the pad surface temperature as observed when the pad contact member 11 shown in FIG. 13, having the zigzag heating flow passage 61 and the zigzag cooling flow passage 62, was in contact with the polishing pad 3. The distributions of pad surface temperature, shown in FIGS. 18 through 20, are those in a radial direction of the polishing pad 3.

The experiments shown in FIGS. 18 through 20 were conducted under the same conditions. The target temperature of the surface of the polishing pad 3 was 55° C. The distance from the center of the polishing table 2 to the center of the pad contact member 11 was equal to the distance from the center of the polishing table 2 to the center of the top ring 1. As will be appreciated from the experimental data shown in FIGS. 18 through 20, in terms of the uniformity of the pad surface temperature, the pad contact member 11 having the heating flow passage 61 and the cooling flow passage 62, each extending in a semicircular shape, is superior to the pad contact member 11 having the spiral heating flow passage 61 and the spiral cooling flow passage 62, and the pad contact member 11 having the spiral heating flow passage 61 and the spiral cooling flow passage 62 is superior to the pad contact member 11 having the zigzag heating flow passage 61 and the zigzag cooling flow passage 62.

Figure 21:
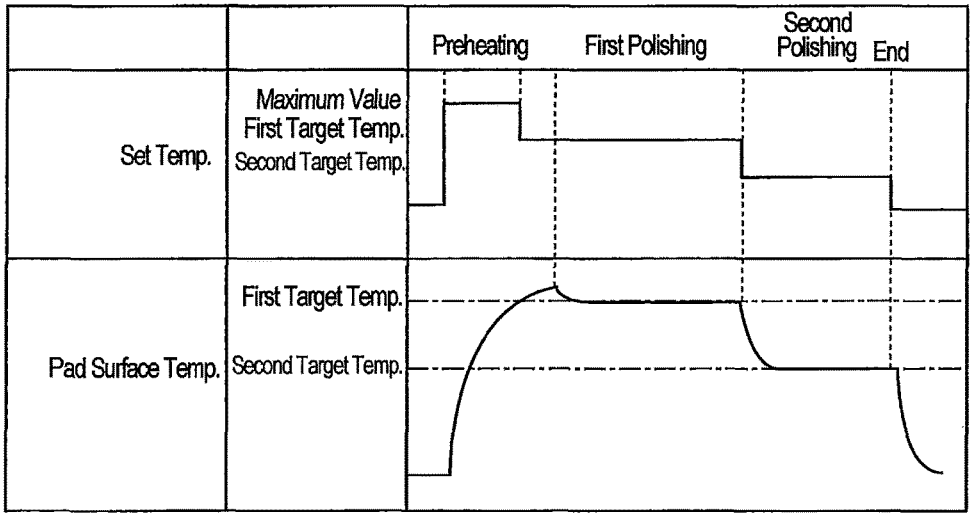
FIG. 21 is a diagram illustrating an embodiment in which a wafer is polished with use of a pad-temperature regulating apparatus.

An embodiment in which the wafer W is polished with the use of the pad-temperature regulating apparatus 5 will now be described with reference to FIG. 21. In the below-described embodiment, the target temperature of the surface of the polishing pad 3 is changed from a first target temperature to a second target temperature during polishing of the wafer W. In one embodiment, the target temperature may be kept constant during polishing of the wafer W.

In this embodiment, before polishing of the wafer W is started, the pad contact member 11 is brought into contact with the surface (i.e., the polishing surface) of the polishing pad 3, so that the surface of the polishing pad 3 is preheated (a preheating step). In this preheating step, the target temperature of the surface of the polishing pad 3 is set at a maximum value. When the pad surface temperature exceeds a first target temperature, the target temperature of the surface of the polishing pad 3 is switched from the maximum value to the first target temperature. The first target temperature is lower than the maximum value. The wafer W is then brought into contact with the surface of the polishing pad 3, whereby polishing of the wafer W is started (a first polishing step). Since the surface of the polishing pad 3 is preheated before the start of polishing of the wafer W, polishing of the wafer W can be started at a high polishing rate.

When a predetermined amount of time has elapsed since the start of the first polishing step or when a thickness of a film of the wafer W reaches a predetermined value, the target temperature of the surface of the polishing pad 3 is changed from the first target temperature to a second target temperature, with the wafer W kept in contact with the polishing pad 3. The wafer W is polished while the surface temperature of the polishing pad 3 is maintained at the second target temperature (a second polishing step).

According to this embodiment, the first polishing step is performed while the surface temperature of the polishing pad 3 is maintained at the first target temperature which is higher than the second target temperature; therefore, the wafer W can be polished at a high polishing rate. In the second polishing step, since the wafer W is polished at a low polishing rate, a film-thickness profile of the wafer W can be adjusted precisely.

Figure 22:
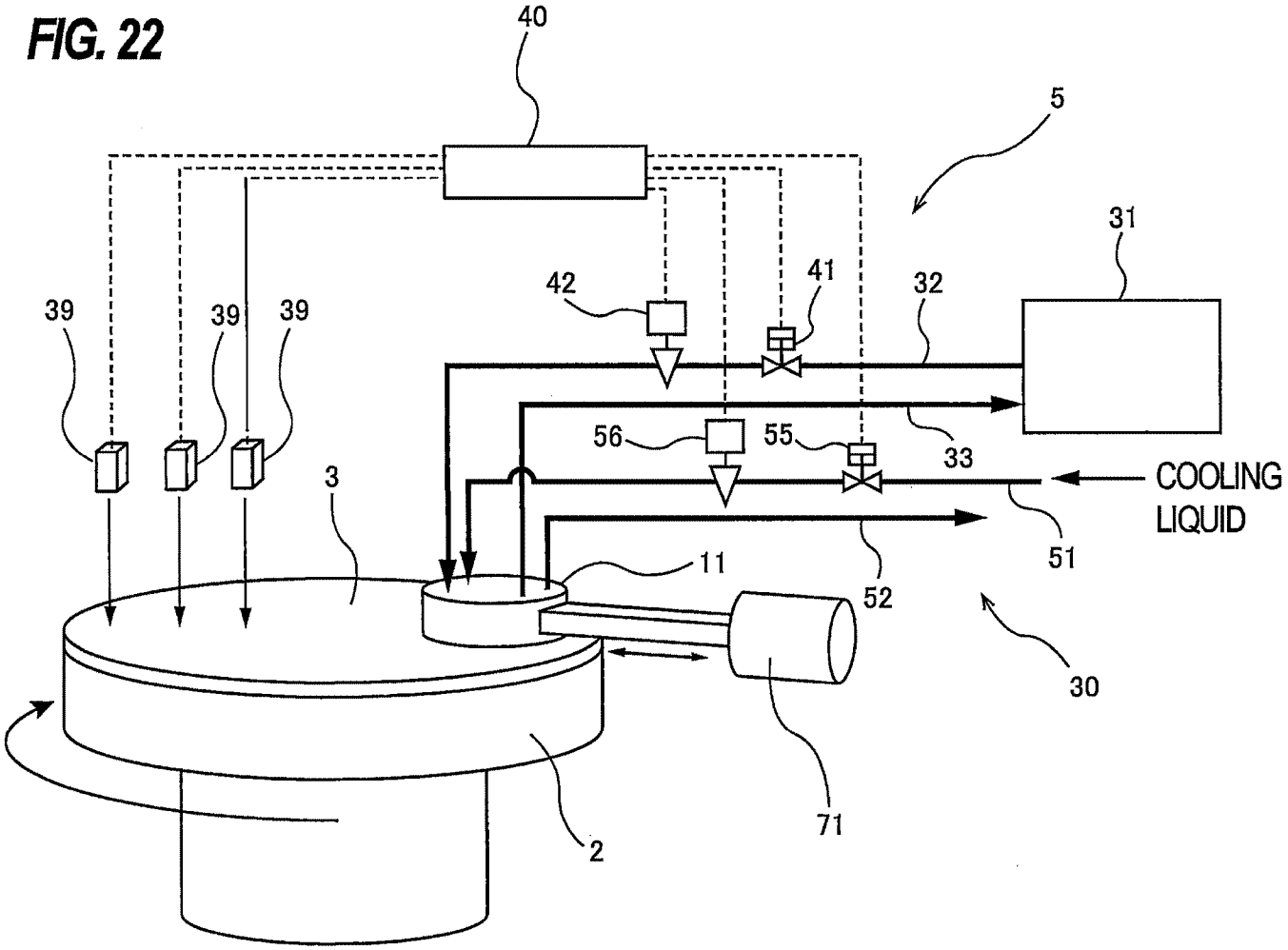
FIG. 22 is a diagram showing another embodiment of a pad-temperature regulating apparatus.

FIG. 22 is a diagram showing another embodiment of pad-temperature regulating apparatus 5. The construction and the operation of this embodiment, which are not particularly described here, are the same as those of the pad-temperature regulating apparatus 5 shown in FIG. 2, and duplicate descriptions thereof are omitted. The depiction of the top ring 1 and the polishing-liquid supply nozzle 4 is omitted from FIG. 22. As shown in FIG. 22, a plurality of pad-temperature measuring devices 39 are arranged along a radial direction of the polishing pad 3. This embodiment uses three pad-temperature measuring devices 39, while it is possible to use two, or four or more pad-temperature measuring devices 39. The plurality of pad-temperature measuring devices 39 are coupled to the valve controller 40.

The pad contact member 11 is held by a slide mechanism 71. This slide mechanism 71 is configured to be capable of moving the pad contact member 11 in a radial direction of the polishing pad 3 while keeping the lower surface (i.e. the pad contact surface) of the pad contact member 11 in contact with the surface of the polishing pad 3. The slide mechanism 71 may be comprised of, for example, a combination of a servomotor and a ball screw mechanism, or an air cylinder.

Based on pad surface temperatures measured by the pad-temperature measuring devices 39, the valve controller 40 operates the slide mechanism 71 so that the distribution of the pad surface temperature becomes a target temperature distribution. Such controlling of the distribution of the pad surface temperature enables controlling of a film-thickness profile of the wafer W which is being polished on the polishing pad 3.

Figure 23:
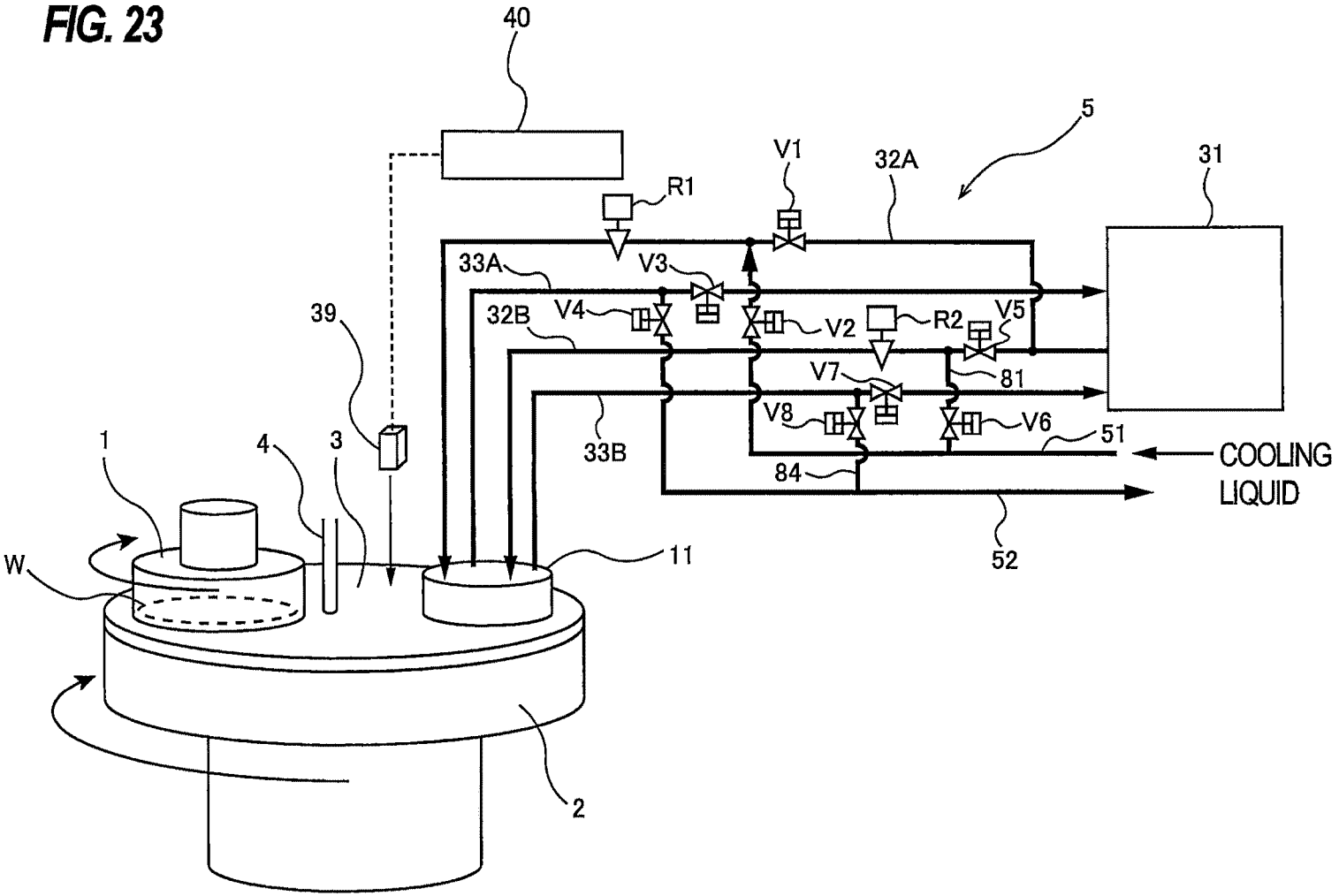
FIG. 23 is a diagram showing yet another embodiment of a pad-temperature regulating apparatus.

FIG. 23 is a diagram showing yet another embodiment of pad-temperature regulating apparatus 5. When rapid warming or cooling of the polishing pad 3 is desired, the cooling liquid or the heating liquid, remaining in the pad contact member 11, may prevent such rapid warming or cooling. The embodiment shown in FIG. 23 is suited to rapidly heat and cool the polishing pad 3.

As shown in FIG. 23, the pad-temperature regulating apparatus 5 includes a first heating-liquid supply pipe 32A and a second heating-liquid supply pipe 32B which are coupled to the heating flow passage 61 and the cooling flow passage 62 of the pad contact member 11, respectively. The pad-temperature regulating apparatus 5 further includes a first heating-liquid return pipe 33A and a second heating-liquid return pipe 33B which are coupled to the heating flow passage 61 and the cooling flow passage 62 of the pad contact member 11, respectively. The second heating-liquid supply pipe 32B is coupled to the heating-liquid supply tank 31, and the first heating-liquid supply pipe 32A branches off from the second heating-liquid supply pipe 32B. The first heating-liquid return pipe 33A and the second heating-liquid return pipe 33B are coupled to the heating-liquid supply tank 31.

The cooling-liquid supply pipe 51 is coupled to the first heating-liquid supply pipe 32A, and the cooling-liquid discharge pipe 52 is coupled to the first heating-liquid return pipe 33A. A first branch pipe 81, which branches off from the cooling-liquid supply pipe 51, is coupled to the second heating-liquid supply pipe 32B, and a second branch pipe 84, which branches off from the cooling-liquid discharge pipe 52, is coupled to the second heating-liquid return pipe 33B.

The first heating-liquid supply pipe 32A is provided with an on-off valve V1 and a flow control valve R1. The second heating-liquid supply pipe 32B is provided with an on-off valve V5 and a flow control valve R2. The cooling-liquid supply pipe 51 is provided with an on-off valve V2, and the cooling-liquid discharge pipe 52 is provided with an on-off valve V4. The first heating-liquid return pipe 33A is provided with an on-off valve V3, and the second heating-liquid return pipe 33B is provided with an on-off valve V7. The first branch pipe 81 is provided with an on-off valve V6, and the second branch pipe 84 is provided with an on-off valve V8. All of these on-off valves and flow control valves are coupled to the valve controller 40, and are operated by the valve controller 40.

In the case of rapidly heating the polishing pad 3, the valve controller 40 opens the on-off valves V1, V3, V5, V7 and closes the on-off valves V2, V4, V6, V8. The flow control valves R1, R2 are fully open. The heating liquid flows through the first heating-liquid supply pipe 32A and the second heating-liquid supply pipe 32B, and is supplied to both of the heating flow passage 61 and the cooling flow passage 62 of the pad contact member 11. The heating liquid further flows through the first heating-liquid return pipe 33A and the second heating-liquid return pipe 33B, and is returned to the heating-liquid supply tank 31. Since the heating liquid is thus supplied to both of the heating flow passage 61 and the cooling flow passage 62 of the pad contact member 11, the pad contact member 11 can rapidly heat the polishing pad 3.

When the surface temperature of the polishing pad 3 exceeds a threshold value, the valve controller 40 opens the on-off valves V6, V8 while keeping the on-off valves V1, V3 open, and closes the on-off valves V5, V7 while keeping the on-off valves V2, V4 closed. The flow control valves R1, R2 are PID-controlled by the valve controller 40 based on a difference between a target temperature and the surface temperature of the polishing pad 3.

In the case of rapidly cooling the polishing pad 3, the valve controller 40 closes the on-off valves V1, V3, V5, V7 and opens the on-off valves V2, V4, V6, V8. The flow control valves R1, R2 are fully open. The cooling liquid flows through the cooling-liquid supply pipe 51, the first heating-liquid supply pipe 32A, the first branch pipe 81, and the second heating-liquid supply pipe 32B, and is supplied to both of the heating flow passage 61 and the cooling flow passage 62 of the pad contact member 11. The cooling liquid is then discharged through the first heating-liquid return pipe 33A, the second heating-liquid return pipe 33B, the second branch pipe 84, and the cooling-liquid discharge pipe 52. Since the cooling liquid is supplied to both of the heating flow passage 61 and the cooling flow passage 62 of the pad contact member 11, the pad contact member 11 can rapidly cool the polishing pad 3.

When the surface temperature of the polishing pad 3 falls below a threshold value, the valve controller 40 opens the on-off valves V1, V3 while keeping the on-off valves V5, V7 closed, and closes the on-off valves V2, V4 while keeping the on-off valves V6, V8 open. The flow control valves R1, R2 are PID-controlled by the valve controller 40 based on a difference between a target temperature and the surface temperature of the polishing pad 3.

Figure 24:
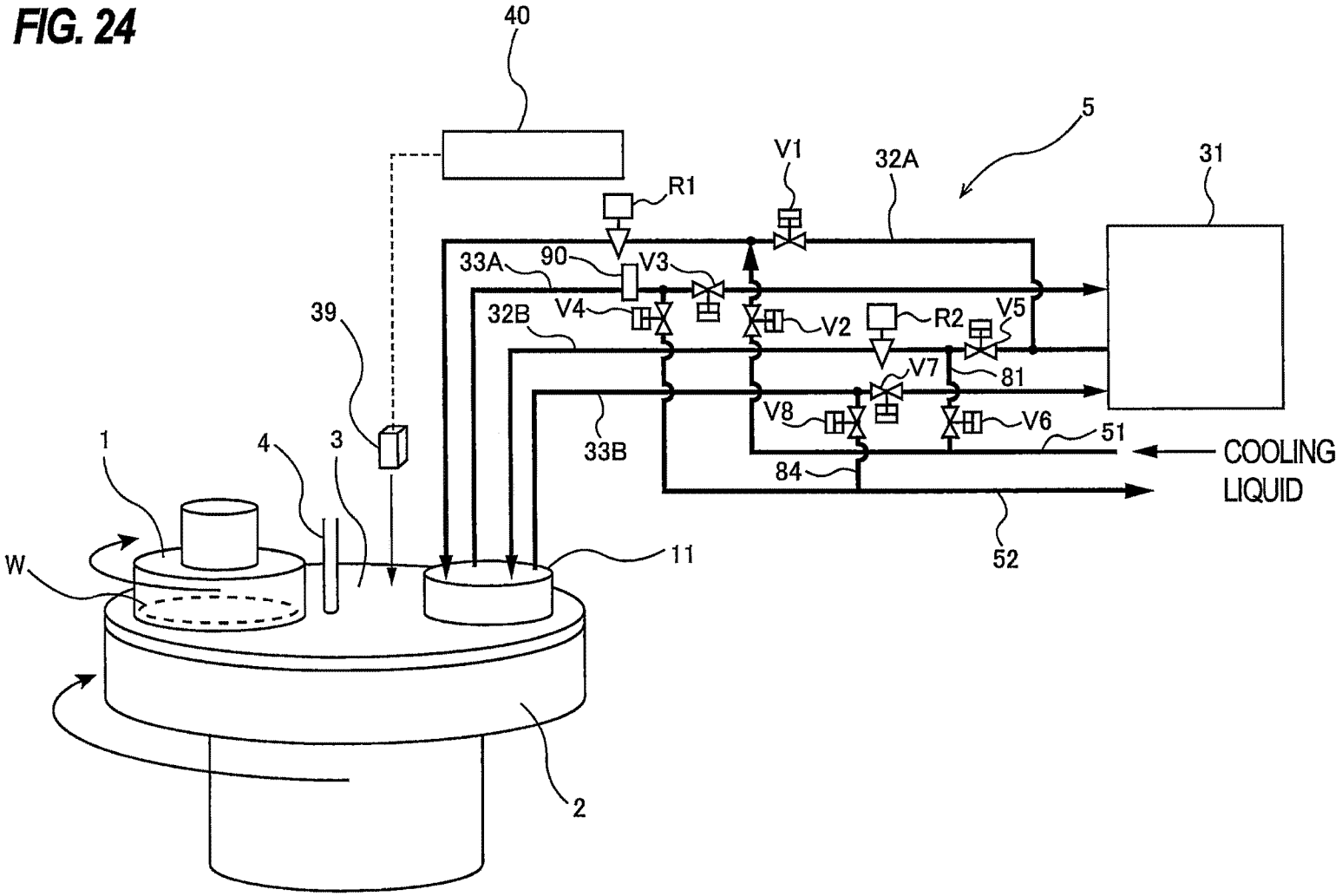
FIG. 24 is a diagram showing yet another embodiment of a pad-temperature regulating apparatus.
Figure 25:
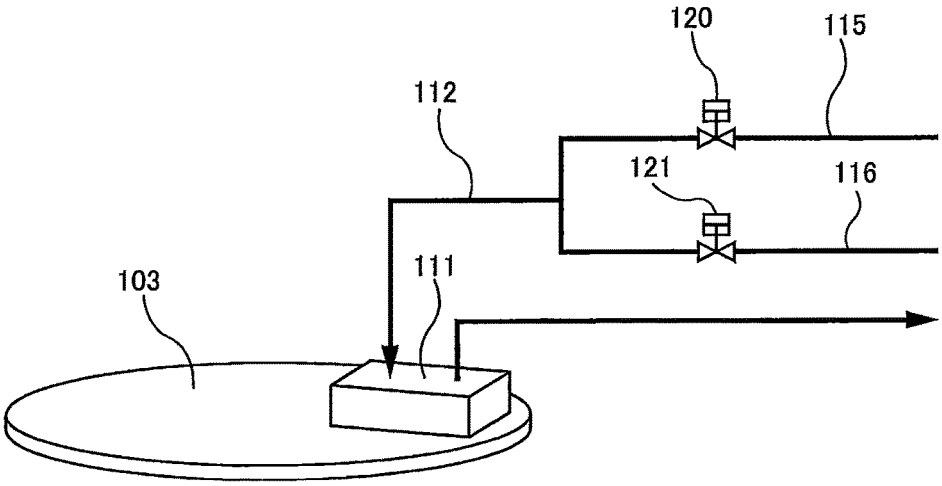
FIG. 25 is a schematic view of a conventional pad-temperature regulating apparatus.
Figure 26:
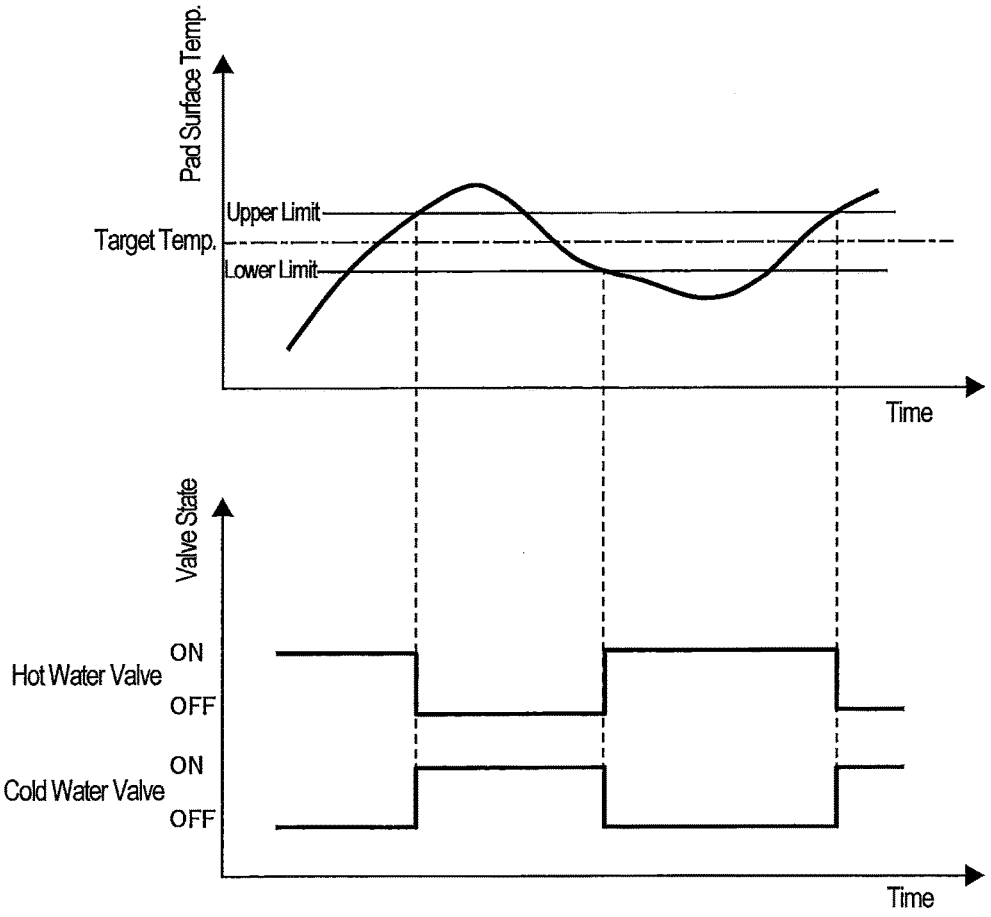
FIG. 26 is a diagram showing operations of a hot water valve and a cold water valve, and change in surface temperature of a polishing pad.
Figure 27:
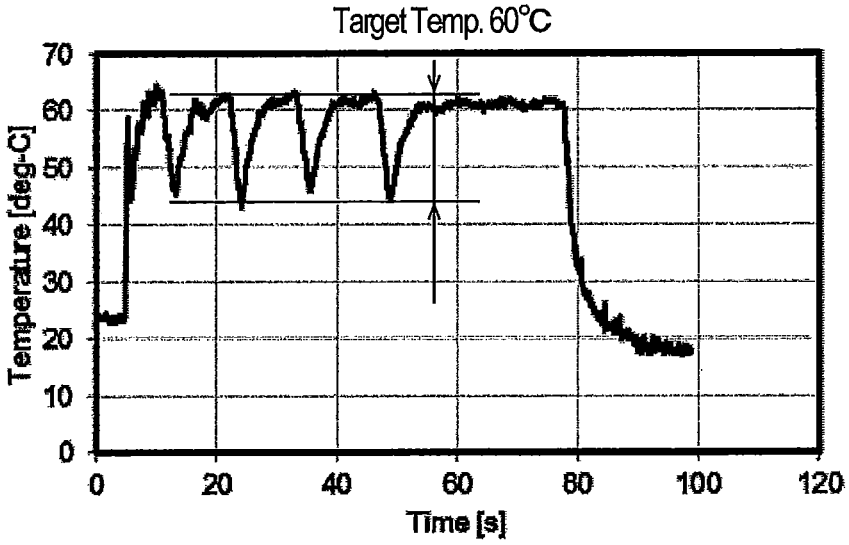
FIG. 27 is a graph showing change in surface temperature of a polishing pad as observed when a target temperature of the polishing pad is set at 60° C.
Figure 28:
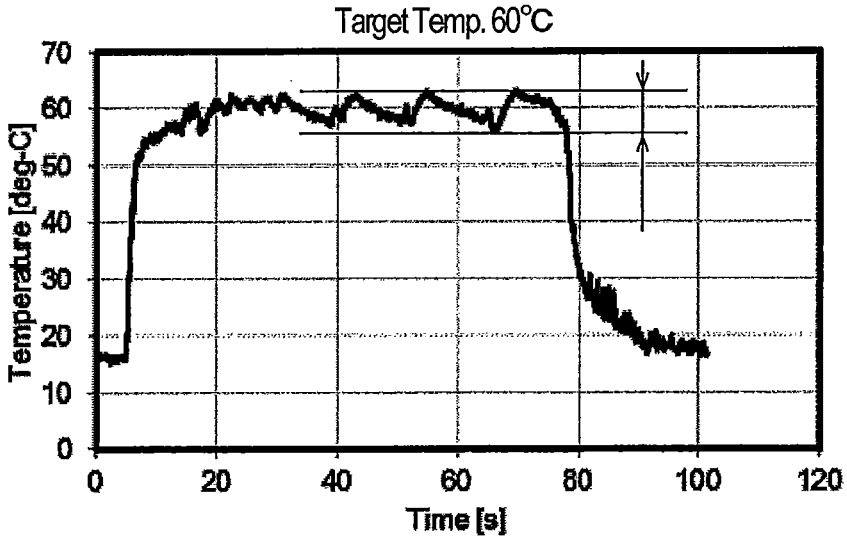
FIG. 28 is a graph showing change in the surface temperature of the polishing pad as observed after making an adjustment to PID control parameters.
Figure 29:
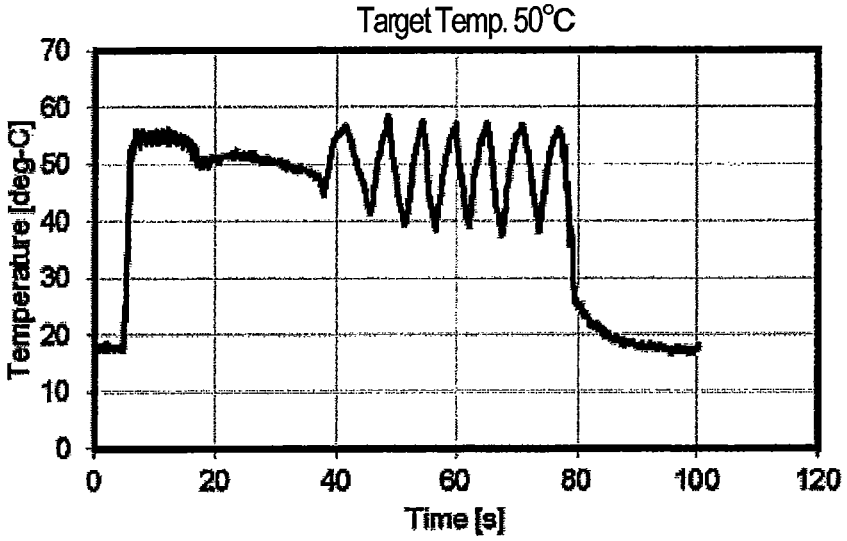
FIG. 29 is a graph showing change in the surface temperature of the polishing pad as observed when the target temperature is changed from 60° C. to 50° C. after making an adjustment to PID control parameters.

If the timing of the opening the on-off valve V3 is too early when the operation of the pad-temperature regulating apparatus 5 is switched from the above-described rapid pad cooling operation to the normal pad temperature control operation, the cooling liquid can flow into the heating-liquid supply tank 31, thus lowering the temperature of the heating liquid to be supplied to the pad contact member 11. It is, therefore, preferred to install a temperature detector 90, such as a temperature sensor or a thermocouple, in the first heating-liquid return pipe 33A, as shown in FIG. 24. The temperature detector 90 is located between the pad contact member 11 and the on-off valve V3. Preferably, the temperature detector 90 is located near the on-off valve V3. The temperature detector 90 is coupled to the valve controller 40.

During the rapid cooling of the polishing pad 3, the on-off valves V2, V4, V6, V8 are open, and the on-off valves V1, V3, V5, V7 are closed. The on-off valve V1 is opened when the pad surface temperature falls below the above threshold value, while the on-off valve V3 is not opened immediately. The valve controller 40 opens the on-off valve V3 and closes the on-off valve V4 when the temperature detector 90 detects that the temperature of the liquid flowing in the first heating-liquid return pipe 33A is not less than a set value. Such an operation can prevent the cooling liquid, remaining in the pad contact member 11 and the first heating-liquid return pipe 33A, from flowing into the heating-liquid supply tank 31.

When switching the liquid, which flows in the first heating-liquid supply pipe 32A and the first heating-liquid return pipe 33A, from the heating liquid to the cooling liquid, the on-off valve V3 may be kept open to allow the heating liquid to be returned to the heating-liquid supply tank 31 until the temperature detector 90 detects that the temperature of the liquid, flowing in the first heating-liquid return pipe 33A, has fallen below a set value (which is different from the above set value). Such an operation can reduce an amount of the heating liquid to be discarded and can efficiently circulate the heating liquid.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. An apparatus for regulating a surface temperature of a polishing pad, comprising:

a pad contact member which is arranged to perform heat exchange with a surface of the polishing pad and which has a heating flow passage and a cooling flow passage formed therein, the heating flow passage and the cooling flow passage extending adjacent to each other and extending in a spiral shape, the heating flow passage and the cooling flow passage including first arc-shaped flow passages and second arc-shaped flow passages, respectively, which are arranged alternately along a direction from a center to a periphery of the pad contact member, the heating flow passage having a first inlet and a first outlet, the cooling flow passage having a second inlet and a second outlet, the first inlet and the second inlet being located at the periphery of the pad contact member, the first outlet and the second outlet being located at the center of the pad contact member;

a heating-liquid supply pipe coupled to the first inlet of the heating flow passage;

a cooling-liquid supply pipe coupled to the second inlet of the cooling flow passage;

a heating-liquid return pipe coupled to the first outlet of the heating flow passage;

a cooling-liquid discharge pipe coupled to the second outlet of the cooling flow passage;

a first flow control valve attached to the heating-liquid supply pipe;

a second flow control valve attached to the cooling-liquid supply pipe;

a pad-temperature measuring device configured to measure a surface temperature of the polishing pad; and a valve controller configured to operate the first flow control valve and the second flow control valve based on the surface temperature of the polishing pad.

2. The apparatus according to claim 1, wherein the heating flow passage and the cooling flow passage are symmetrical with respect to a radial direction of the polishing pad.

3. The apparatus according to claim 1, wherein the valve controller is configured to determine a manipulated variable for the first flow control valve and a manipulated variable for the second flow control valve which are necessary to eliminate a difference between a target temperature and the surface temperature of the polishing pad.

4. The apparatus according to claim 1, wherein where a manipulated variable for the first flow control valve and a manipulated variable for the second flow control valve are each expressed as a numerical value ranging from 0% to 100%, the valve controller is configured to determine the manipulated variable for one of the first flow control valve and the second flow control valve by subtracting the manipulated variable for the other one of the first flow control valve and the second flow control valve from 100%.

5. The apparatus according to claim 1, wherein the heating flow passage further includes first oblique flow passages that couple the first arc-shaped flow passages to each other, and the cooling flow passage further includes second oblique flow passages that couple the second arc-shaped flow passages to each other.

6. The apparatus according to claim 1, wherein each of the first arc-shaped flow passages has a constant curvature, and each of the second arc-shaped flow passages has a constant curvature.

7. The apparatus according to claim 1, wherein an outermost one of the first arc-shaped flow passages and an outermost one of the second arc-shaped flow passages are located at the periphery of the pad contact member.

8. An apparatus for regulating a surface temperature of a polishing pad, comprising:

a pad contact member which is arranged to perform heat exchange with a surface of the polishing pad and which has a heating flow passage and a cooling flow passage formed therein, the heating flow passage having a first inlet and a first outlet, the cooling flow passage having a second inlet and a second outlet, the first inlet and the second inlet being located at the periphery of the pad contact member, the first outlet and the second outlet being located at the center of the pad contact member;

a heating-liquid supply pipe coupled to the first inlet of to the heating flow passage;

a cooling-liquid supply pipe coupled to the second inlet of to the cooling flow passage, the cooling-liquid supply pipe being separated from the heating-liquid supply pipe;

a heating-liquid return pipe coupled to the first outlet of the heating flow passage;

a cooling-liquid discharge pipe coupled to the second outlet of the cooling flow passage;

a first flow control valve attached to the heating-liquid supply pipe;

a second flow control valve attached to the cooling-liquid supply pipe;

a pad-temperature measuring device configured to measure a surface temperature of the polishing pad; and a valve controller configured to operate the first flow control valve and the second flow control valve based on the surface temperature of the polishing pad.

9. The apparatus according to claim 8, wherein the heating flow passage and the cooling flow passage extend adjacent to each other and extend in a spiral shape.

10. The apparatus according to claim 9, wherein the heating flow passage includes first oblique flow passages, and the cooling flow passage includes second oblique flow passages.

11. The apparatus according to claim 1, wherein the heating flow passage and the cooling flow passage are point-symmetrical and have a same length.

12. The apparatus according to claim 1, wherein an outermost one of the first arc-shaped flow passages has the first inlet, an outermost one of the second arc-shaped flow passages has the second inlet.

13. The apparatus according to claim 1, wherein the first inlet and the second inlet are located symmetrically with respect to the center of the pad contact member.

14. The apparatus according to claim 8, wherein the heating flow passage and the cooling flow passage are point-symmetrical and have a same length.

15. The apparatus according to claim 8, wherein the first inlet and the second inlet are located symmetrically with respect to the center of the pad contact member.

* * * * *